US010385619B2

(12) United States Patent
Huang et al.

(10) Patent No.: US 10,385,619 B2
(45) Date of Patent: Aug. 20, 2019

(54) COMPUTING SYSTEMS, TOOLS, AND METHODS FOR SIMULATING WELLBORE DEPARTURE

(71) Applicant: SMITH INTERNATIONAL, INC., Houston, TX (US)

(72) Inventors: Sujian Huang, Beijing (CN); Xinghan Liu, Beijing (CN); Jianjun Yang, Beijing (CN); Gang Xu, Beijing (CN); Feng Feng, Beijing (CN)

(73) Assignee: SMITH INTERNATIONAL, INC., Houston, TX (US)

( * ) Notice: Subject to any disclaimer, the term of this patent is extended or adjusted under 35 U.S.C. 154(b) by 990 days.

(21) Appl. No.: 14/584,424

(22) Filed: Dec. 29, 2014

(65) Prior Publication Data

US 2015/0186570 A1 Jul. 2, 2015

Related U.S. Application Data

(60) Provisional application No. 61/922,405, filed on Dec. 31, 2013, provisional application No. 62/097,362, filed on Dec. 29, 2014.

(51) Int. Cl.
*G06G 7/48* (2006.01)
*E21B 7/06* (2006.01)

(52) U.S. Cl.
CPC ..... *E21B 7/061* (2013.01)

(58) Field of Classification Search
CPC ..... E21B 7/061
USPC ..... 703/10
See application file for complete search history.

(56) References Cited

U.S. PATENT DOCUMENTS

| | | | |
|---|---|---|---|
| 5,918,674 | A | 7/1999 | Head et al. |
| 6,516,293 | B1 | 2/2003 | Huang et al. |
| 6,785,641 | B1 | 8/2004 | Huang |
| 6,873,947 | B1 | 3/2005 | Huang et al. |
| 7,020,597 | B2 | 3/2006 | Oliver et al. |
| 7,139,689 | B2 | 11/2006 | Huang |
| 7,464,013 | B2 | 12/2008 | Huang et al. |
| 7,693,695 | B2 | 4/2010 | Huang et al. |
| 7,844,426 | B2 | 11/2010 | Huang et al. |
| 8,185,366 | B2 | 5/2012 | Huang et al. |

(Continued)

FOREIGN PATENT DOCUMENTS

| | | | |
|---|---|---|---|
| EP | 881357 | A2 | 12/1998 |
| WO | 2005008019 | A1 | 1/2005 |
| WO | 2012174295 | A2 | 12/2012 |

OTHER PUBLICATIONS

International Preliminary Report on Patentability issued in PCT application PCT/US2014/072648 dated Jul. 14, 2016, 9 pages.

(Continued)

*Primary Examiner* — Hugh M Jones

(57) ABSTRACT

Specialized computing systems, devices, interfaces and methods facilitate the simulation of downhole milling procedures such as wellbore departure milling procedures. Computing systems, devices, interfaces and methods enable a user to design and select milling components and procedures to be compared and simulated. Various milling parameters, such as milling tool parameters, whipstock parameters, and wellbore casing parameters may be accessed and selectably modified with milling and simulation interfaces to define and control the simulated milling procedures. Different types of output are selectably rendered to reflect various aspects of the simulated milling procedures.

24 Claims, 21 Drawing Sheets

(56) References Cited

U.S. PATENT DOCUMENTS

| | | | |
|---|---|---|---|
| 8,401,831 | B2 | 3/2013 | Tang et al. |
| 2002/0148617 | A1 | 10/2002 | Dewey et al. |
| 2004/0143427 | A1 | 7/2004 | Huang et al. |
| 2005/0096847 | A1 | 5/2005 | Huang |
| 2005/0145389 | A1 | 7/2005 | Barrow et al. |
| 2005/0216197 | A1 | 9/2005 | Zamora et al. |
| 2006/0293872 | A1 | 12/2006 | Zamora et al. |
| 2007/0203681 | A1 | 8/2007 | Eyvazzadeh et al. |
| 2008/0255817 | A1 | 10/2008 | Pabon et al. |
| 2009/0198478 | A1 | 8/2009 | Cuevas et al. |
| 2011/0153300 | A1 | 6/2011 | Holl et al. |
| 2013/0006597 | A1 | 1/2013 | Craig et al. |

OTHER PUBLICATIONS

International Preliminary Report on Patentability issued in PCT application PCT/US2014/072646 dated Jul. 14, 2016, 14 pages.
International Preliminary Report on Patentability issued in related PCT application PCT/US2014/072643 dated Jul. 14, 2016, 15 pages.
International Search Report and Written Opinion issued in PCT/US2014/072646 dated May 15, 2015; 18 pages.
International Search Report and Written Opinion issued in PCT/US2014/072643 dated May 15, 2015; 18 pages.
International Search Report and Written Opinion issued in PCT/US2014/072648 dated Apr. 13, 2015; 14 pages.

| | A | B | C | D |
|---|---|---|---|---|
| 1 | 1.7000 | 6.5000 | 11.0000 | 3.8150 |
| 2 | 2.2000 | 13.6879 | 11.0000 | 10.1250 |

| | A | B | C | D |
|---|---|---|---|---|
| 1 | 0.0000 | 6.4920 | 11.0000 | 2.6000 |
| 2 | 3.0000 | 2.7800 | 11.0000 | 4.3483 |
| 3 | 1.5000 | 2.2000 | 11.0000 | 5.0396 |
| 4 | 15.0000 | .02500 | 11.0000 | 5.8435 |
| 5 | 3.0000 | 6.8080 | 11.0000 | 10.1250 |

COMPUTING SYSTEMS, TOOLS, AND METHODS FOR SIMULATING WELLBORE DEPARTURE

CROSS-REFERENCE TO RELATED APPLICATIONS

This application claims the benefit of and priority to U.S. Provisional Patent Application Ser. No. 61/922,405 filed on Dec. 31, 2013, entitled "METHODS FOR ANALYZING AND OPTIMIZING DOWNHOLE MILLING OPERATIONS," and to U.S. Provisional Patent Application Ser. No. 62/097,362 filed on Dec. 29, 2014, entitled "COMPUTING SYSTEMS, TOOLS, AND METHODS FOR SIMULATING DOWNHOLE OPERATIONS." This application is also related to U.S. patent application Ser. No. 14/584,477, filed contemporaneously herewith, entitled "COMPUTING SYSTEMS, TOOLS, AND METHODS FOR SIMULATING WELLBORE RE-ENTRY," and U.S. patent application Ser. No. 14/584,525, filed contemporaneously herewith, entitled "COMPUTING SYSTEMS, TOOLS, AND METHODS FOR SIMULATING WELLBORE ABANDONMENT." Each of the foregoing applications is expressly incorporated herein by reference in its entirety.

BACKGROUND

Operations, such as geophysical surveying, drilling, milling, logging, well completion, hydraulic fracturing, steam injection, and production, are typically performed to locate and collect valuable subterranean assets. Examples of subterranean assets may include fluids (e.g., hydrocarbons such as oil or gas, water, etc.), as well as minerals, and other materials. After collecting valuable subterranean assets, operations such as well abandonment may involve the sealing of a well to safely and economically decommission a well. In some cases, a wellbore may be formed in a subterranean formation, and a casing may be installed.

Occasionally, a wellbore departure procedure may be performed utilizing a process known as sidetracking. During a sidetracking procedure, a deviated borehole is formed as a borehole branching laterally off a wellbore. The deviated borehole may be formed in a cased or openhole section of the wellbore. When the wellbore is cased, the deviated borehole may be formed at an exit through the casing and the wellbore wall by using a milling bottomhole assembly (BHA). A whipstock or "whip" is also used to force the milling BHA to mill through and depart out of the wellbore at a desired trajectory.

SUMMARY

In some embodiments, systems, interfaces, methods and computer-readable media are operable to simulate downhole milling procedures to predict the effectiveness of milling processes and assemblies and to reflect how different configurations of milling assemblies and milling tool and process parameters can change performance for different anticipated milling assemblies and procedures.

In some embodiments, simulated milling procedures are performed by one or more computing systems that are configured with one or more processors and specialized interface, virtualizing, and simulation engines. These computing systems may also include other interfaces and computer-executable instructions that, when executed by the one or more processors, are operable to implement the functionality described herein for analyzing and simulating milling procedures involving different combinations of milling tool parameters, whipstock parameters, wellbore casing parameters, and simulation parameters.

In at least some embodiments, aspects of the present disclosure relate to graphical user interfaces that are utilized to access or modify milling parameters, milling tool parameters, whipstock parameters, wellbore casing parameters, and simulation parameters for corresponding milling procedures, as well as to render output corresponding to the simulated milling procedures.

In accordance with some embodiments of the disclosure, a computing system is provided with one or more hardware processors and one or more storage devices having stored computer-executable instructions which, when executed by the one or more hardware processors, are configured to cause the computing system to access parameters of a virtual whipstock and parameters of a virtual milling tool, to simulate a milling procedure by at least simulating an interaction of the virtual milling tool virtual with the virtual whipstock, and to render one or more visual outputs associated with the simulated milling procedure.

In some embodiments, a computer program product is provided that includes one or more computer hardware storage devices having stored computer-executable instructions which, when executed by one or more processors of a computing system, implement a method for simulating a downhole milling procedure.

A downhole milling procedure may be simulated by utilizing an interface engine to access one or more files containing any combination of milling tool parameters that specify characteristics of one or more virtual milling tools, whipstock parameters that specify characteristics of one or more virtual whipstocks, or wellbore casing parameters that specify characteristics of one or more virtual wellbore casings.

An interface engine may be utilized to generate a milling user interface that displays interactive elements that, in response to user input directed at the interactive elements, are operable for selecting and/or modifying any combination of milling tool parameters, whipstock parameters, wellbore casing parameters, and milling simulation parameters. In response to user input directed at the interactive elements, the system responsively performs any combination of accessing, selecting, or modifying at least one of the milling tool parameters, the whipstock parameters, the wellbore casing parameters, or the simulation parameters.

A virtualizing engine may be utilized to generate a visual representation of one or more virtual milling tools, virtual whipstocks, or virtual wellbore casings corresponding to user input.

An interface engine may also be utilized to select one or more simulation parameters and one or more simulation components corresponding to a downhole milling procedure. The selected one or more simulation components may include at least one of virtual milling tools, virtual whipstocks, or virtual wellbore casings. In some embodiments, the virtual milling tools, virtual whipstocks, or virtual wellbore casings may be selected or modified by user input.

A simulation engine may also be utilized to perform a milling simulation involving one or more selected simulation parameters and one or more selected simulation components during a downhole milling procedure. Outputs, such as visual outputs, may also be rendered to reflect aspects of the milling simulation for downhole milling procedures.

In some embodiments, a computer implemented method is performed for simulating downhole milling procedures by generating a milling user interface that displays interactive elements that, in response to user input directed at the interactive elements, are operable for identifying milling tool parameters of one or more virtual milling tools, whipstock parameters of one or more virtual whipstocks, and wellbore casing parameters of one or more virtual wellbore casings.

In response to receiving the user input directed at the interactive elements, a visual representation of at least one of the one or more virtual milling tools, whipstocks, wellbore casings, or the virtual downhole milling procedure may be generated.

In some embodiments, identified one or more simulation components include at least one of one or more virtual milling tools, one or more virtual whipstocks, or one or more virtual wellbore casings as selected or modified by user input directed at interactive elements of the milling interface. A milling simulation may also be performed, based on the one or more simulation parameters and the identified one or more simulation components. One or more outputs associated with the milling simulation may also be rendered.

In some instances, the milling simulation generates milling performance parameters that can be represented by the output, including one or more of stress, vibration, bending moment, wear rate, whipstock material removal, resulting whipstock shape, contact force, rate of penetration, downhole weight-on-bit, downhole rotational speed, surface torque, resulting mill trajectory, window quality, window shape, walk rate, walk direction, or milling tool deformation.

This summary is provided to introduce a selection of concepts that are further described in the figures and the detailed description. This summary is not intended to identify key or essential features, nor is it intended to be used as an aid in limiting the scope of the disclosure, including the claimed subject matter. Additional features of embodiments of the disclosure will be set forth in the description and figures, and in part will be obvious from the disclosure herein, or may be learned by the practice of such embodiments. Features and aspects of such embodiments may be realized and obtained by means of the instruments and combinations particularly pointed out in the appended claims, and otherwise described herein. These and other features will become more fully apparent from the following description and appended claims, or may be learned by the practice of such embodiments.

BRIEF DESCRIPTION OF THE DRAWINGS

A more particular description will be rendered by reference to specific, example embodiments which are illustrated in the appended drawings. While some of the drawings may be schematic or exaggerated representations of concepts, at least some of the drawings may be drawn to scale. Such scale drawings should be understood to be so scale for some embodiments, but not to scale for other embodiments contemplated herein. Understanding that the drawings depict some example embodiments, the embodiments will be described and explained with additional specificity and detail through the use of the accompanying drawings in which.

DETAILED DESCRIPTION

One or more specific embodiments of the present disclosure are described herein. Some embodiments of the present disclosure relate to simulating downhole operations. Some embodiments of the present disclosure relate to simulating milling operations. Some embodiments of the present disclosure relate to methods, systems, interfaces, and computer-readable media for simulating downhole milling operations including, but not limited to, wellbore departure and other sidetracking operations. These described embodiments are examples of the presently disclosed techniques. Additionally, in an effort to provide a concise description of these embodiments, not all features of some actual embodiments may be described or illustrated. It should be appreciated that in the development of any such actual embodiments, as in any engineering or design project, numerous embodiment-specific decisions will be made to achieve the developers' specific goals, such as compliance with system-related and business-related constraints, which may vary from one embodiment to another. It should further be appreciated that such a development effort might be complex and time consuming, but would nevertheless be a routine undertaking of design, fabrication, and manufacture for those of ordinary skill having the benefit of this disclosure.

Simulated milling operations according to embodiments of the present disclosure can, in some instances, help in the design, selection, or modification of a BHA for particular milling procedures in less time and/or in a more efficient way than was previously possible. Interfaces and systems of the disclosure can also, in some instances, improve the usability of simulation tools and stored files containing parameters associated with milling tool components and milling procedures. Embodiments of the present disclosure may also, in some embodiments, improve the efficacy of computing systems that are used to identify and build BHAs and BHA components, through at least performing the aforementioned simulations. For example, by making simulated predictions of defined milling procedures, which are performed by defined milling assemblies, it can be possible to compare and identify assemblies and procedures that can be utilized to reduce costs and increase efficiency when performing actual downhole milling procedures, such as wellbore departures and other sidetracking operations.

Most of the terms used herein will be recognizable to those of skill in the art. In certain instances, however, terms may be explicitly defined. Any terms not explicitly defined should be interpreted as adopting a meaning presently accepted by those skilled in the art.

Figure 1:
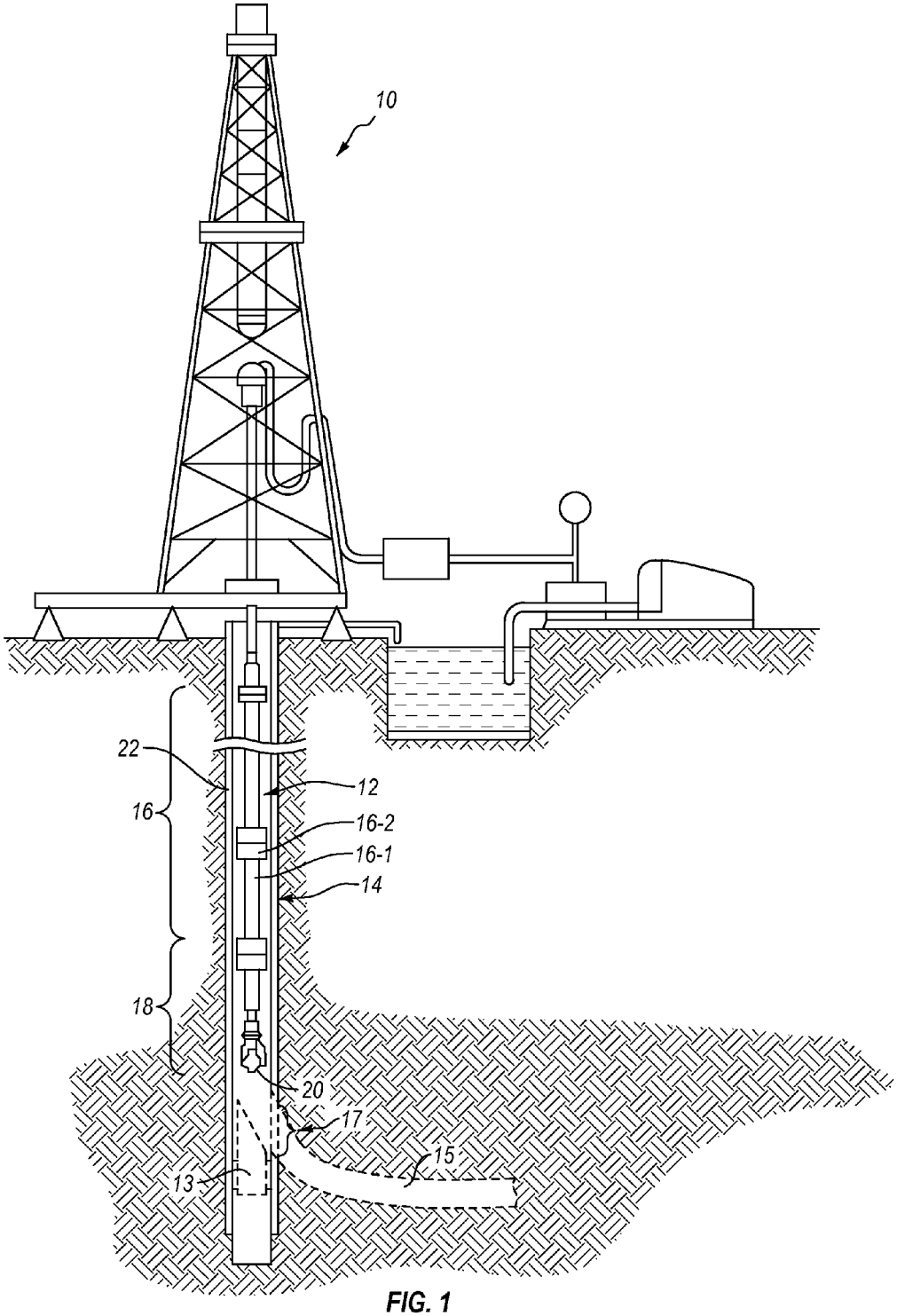
FIG. 1 is a partial, cross-sectional side view of a general drilling environment and an example drilling system for drilling an earth formation, in accordance with one or more embodiments of the present disclosure.

FIG. 1 shows one example of a drilling system for drilling an earth formation. The drilling system of FIG. 1 includes a drilling rig 10 which may be used to turn a drilling tool assembly 12 that extends downward into a wellbore 14. The drilling tool assembly 12 may include a drill string 16 and a bottomhole assembly (BHA) 18 coupled to a downhole end portion of the drill string 16. As will be appreciated by one having ordinary skill in the art, the downhole end portion of the drill string 16 may be a portion furthest from the drilling rig 10 and/or the surface of the wellbore 14. The downhole end portion of the drill string 16 may be located within the wellbore 14 or in another location (e.g., within a deviated borehole during or as a result of a wellbore departure operation).

The drill string 16 may include several joints of drill pipe 16-1 connected end-to-end through tool joints 16-2. The drill string 16 may be used to transmit drilling fluid (e.g., through its hollow core) and/or to transmit rotational power from the drill rig 10 to the BHA 18. In some cases, the drill string 16 may further include additional components such as subs, pup joints, etc. In some embodiments, the drill string 16 may include a single or extended string component (e.g., coiled tubing). Optionally, the rotational power for rotating the BHA 18 may be provided by one or more downhole components (e.g., turbine motor, mud motor, etc.)

The drill string 16 may also have at least a lead mill that is specifically designed to mill through the casing 22 to create a casing window 17 (sometimes referred to herein as a 'window') leading into the subterranean formation. This lead mill can include a bit 20 that is specifically configured for metal cutting (e.g., a window mill bit, a lead mill bit, or a taper mill bit for milling the casing window 17 out of the casing 22). In other embodiments, the bit 20 may be a drill bit configured to drill formation. For instance, the bit 20 may be a roller cone bit, percussive hammer bit, fixed cutter bit, impregnated bit, bi-center bit, or other type of drill bit.

To mill through a casing, rotational moment, radial, and axial force must be applied to the mill(s) to cause the bits or other corresponding cutting elements of the mill(s) to mill into the casing during rotation of the mill(s). The weight on bit (WOB), rotary speed and torque, whipstock configuration, casing thickness, casing material, type of lead mill, and other factors may affect the rate at which the portion (i.e., window) of casing is milled, the quality of the window formed in the casing, the rate of wear on the mill, and the like.

During a downhole milling procedure, the milling BHA assembly can be subjected to various vibrations resulting from the different forces at play. These vibrations, which can include any combination of torsional, axial, and lateral vibrations, can have a very detrimental effect on the milling procedure and the overall integrity of the milling tools. In some instances, the vibrations and forces involved in the downhole milling procedures can result in off centered milling, slower rates of penetration, excessive wear of the cutting elements, premature failure of the milling tool components, over gage milling, and out-of-round milling.

When the mill wears out or breaks during a milling operation, the entire milling assembly is often lifted out of the wellbore, section-by-section, and disassembled to replace the broken milling components. Because the length of a milling assembly and drill string may extend for more than a mile, pipe trips can take hours to complete and can pose a significant expense to the wellbore operator.

Although not specifically illustrated, the BHA 18 may also include additional or other components coupled to the drill string 16 (e.g., between the drill string 16 and the bit 20). Example additional or other BHA components may include drill pipe, drill collars, transition drill pipe (e.g., heavy weight drill pipe), stabilizers (e.g., fixed and/or expandable stabilizers), measurement-while-drilling (MWD) tools, logging-while-drilling (LWD) tools, subs (e.g., shock subs, circulation subs, disconnect subs, etc.), hole enlargement devices (e.g., hole openers, reamers, etc.), jars, thrusters, downhole motors (e.g., turbines and mud motors), jars, drill pipe, drill collar, transition drill pipe (e.g., HEVI-WATE® drill pipe), rotary steerable systems, vibration dampening tools, vibration inducing tools (e.g., axial, torsional, or lateral), cross-overs, circulation subs, disconnect subs, mills (e.g., follow mills, dress mills, watermelon mills, taper mills, drill-mills, junk mills, section mills, rotary steerable mills, casing mills, etc.), or other tools.

When drilling or milling, sufficient rotational moment and axial force may be applied to the bit 20 to cause cutting elements of the bit 20 to cut into, shear, crush, or otherwise degrade the subterranean formation or the casing 22. The axial force applied on the bit 20 may be referred to as "weight-on-bit" (WOB). The rotational moment applied to the drilling tool assembly 12 at the drill rig 10 (e.g., by a rotary table or a top drive mechanism) or using a downhole motor to turn the drilling tool assembly 12 may be referred to as the "rotary torque." Additionally, the speed at which the rotary table or other device rotates the drilling tool assembly 12, measured in revolutions per minute (RPM), may be referred to as the "rotary speed."

Drilling typically refers to using a drill bit (e.g., bit 20) to remove earth formation to extend a length of a wellbore (e.g., wellbore 14). The drill bit can be configured with a plurality of cutting elements (e.g., polycrystalline diamond compacts, cubic boron nitride cutters, metal carbide cutters (e.g., tungsten carbide cutters), impregnated diamond, roller cone teeth, or other specially manufactured cutters, teeth, or other cutting elements).

Once the wellbore 14 has been drilled, or while the wellbore 14 is being drilled, it may be useful to line, or "case," the wellbore. Casing the wellbore 14 may protect the wellbore from the collapse of the earth formation wall into the wellbore, provide strength for the installation of equipment, isolate the wellbore (or portions thereof) from fluids of the surrounding formation, or for myriad other reasons. Prior to casing, the wellbore, or a section of the wellbore, is referred to as "openhole."

The liner used in casing the wellbore is referred to as "casing" and is shown in FIG. 1 as casing 22. Casing 22 may include a pipe or other tubular element that is lowered into the wellbore. The casing 22 may be cemented into place. The cement may surround the entirety or a portion of the outer surface of the casing 22. The casing 22 may be formed from a high strength material such as stainless steel, aluminum, titanium, fiberglass, other materials, or some combination of the foregoing. Optionally, the casing 22 may include a number of couplings and/or collars that connect a number of casing sections, or pipes, to one another. A series of connected casings is known as a casing string.

Figure 6:
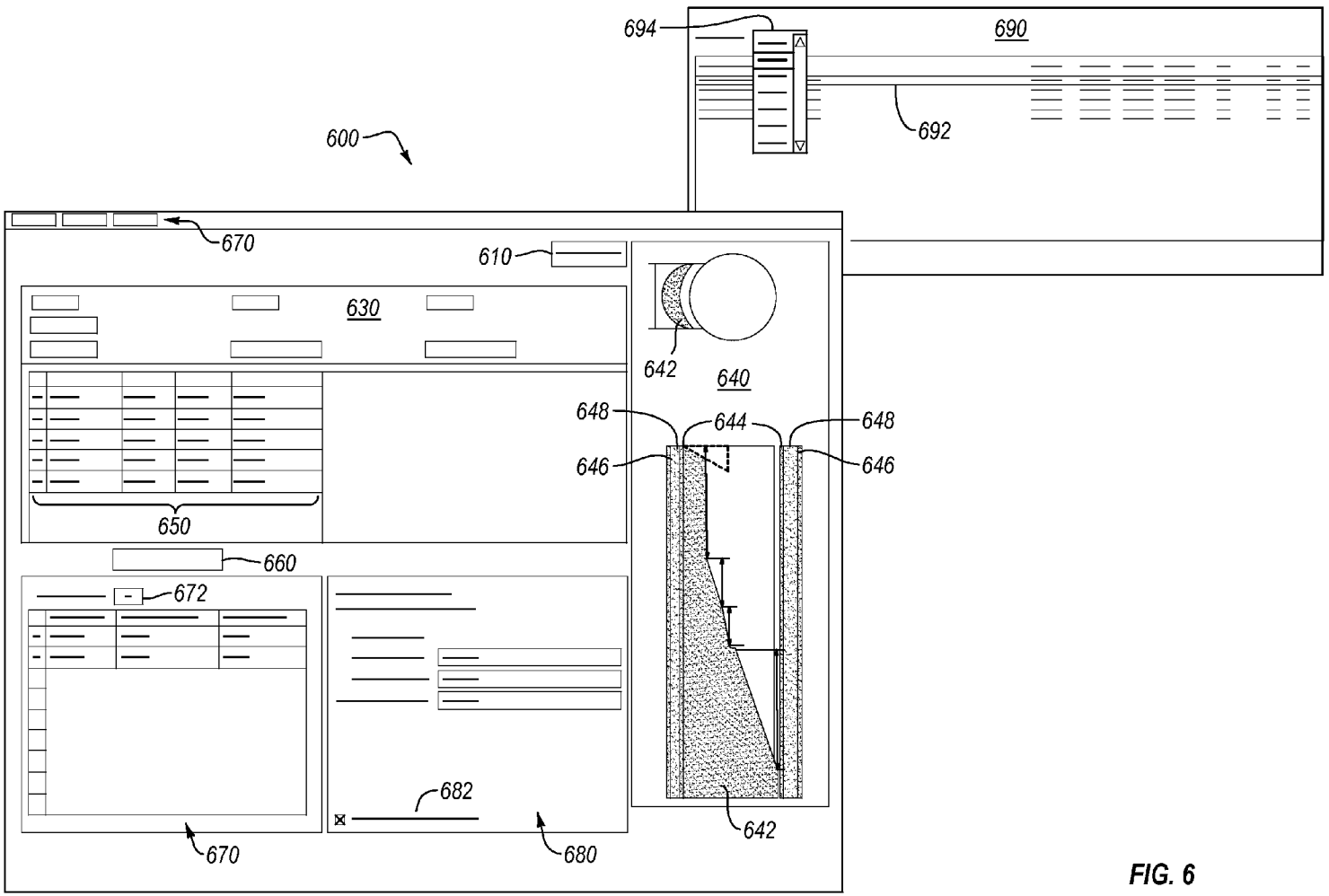

A plurality of different casings can also be nested within one another (see FIG. 6). In some embodiments, a cement layer may be positioned between layers of nested casings. The term "casing" is intended to encompass casing which extends from the surface to a downhole location, as well as liners which do not extend fully to surface (e.g. liner suspended from a casing or upper liner through using a liner hanger).

During drilling, it may be desired to change the trajectory of a wellbore. For example, it may be desired to change the trajectory of a substantially vertically drilled wellbore to a substantially horizontally drilled wellbore (or vice versa). The transition from vertical drilling to horizontal drilling (or vice versa) is known as directional drilling. Directional drilling involves certain terms of art, which are presented below for background information.

A method used to obtain the measurements to calculate and plot a three-dimensional well path may be called a "directional survey." Various parameters may be measured at multiple locations along the well path. Example parameters may include measure depth, inclination, and hole direction. Measure depth may be the actual depth of the hole drilled to any point along the wellbore, or the total depth as measured from a surface location. Inclination may be the angle, measured in degrees, by which the wellbore or survey-instrument axis varies from a true vertical line. An inclination of 0° would be true vertical, and an inclination of 90° would be horizontal. The "build rate" is the positive change in inclination over a normalized length (e.g., 3°/100 ft. or 3°/30.5 m). A negative change in inclination would be the "drop rate."

Hole direction may be the angle, measured in degrees, of a horizontal component of the wellbore or survey-instrument axis from a known north reference. This north reference may be true north, magnetic north, or grid north, and may be measured clockwise by convention. Hole direction may be measured in degrees and expressed in either azimuth (0° to 360°) or quadrant (Northeast (NE), Southeast (SE), Southwest (SW), Northwest (NW)) form.

A long-radius horizontal well may be characterized by build rates of 2° to 6°/100 ft. (2° to 6°/30.5 m), which may result in a radius of 3,000 ft. to 1,000 ft. (915 m to 305 m), respectively. A long-radius horizontal well may be drilled with conventional directional drilling tools, and lateral sections of up to 8,000 ft. (2,440 m) have been drilled. Medium-radius horizontal wells may have build rates of 6° to 35°/100 ft. (6° to 35°/30.5 m), radii of 1,000 ft. to 160 ft. (305 m to 50 m), respectively, and lateral sections of up to 8,000 ft. (2,440 m). Example medium-radius wells may be drilled with specialized downhole mud motors and conventional drill string components. In some embodiments. Double-bend assemblies may be used which are designed to build angles at rates up to 35°/100 ft. (35°/30.5 m). The lateral section may then be drilled with conventional steerable motor assemblies.

Short-radius horizontal wells may have build rates of 5° to 10°/3 ft. (1.5° to 3°/ft. or 5.5° to 11°/m), which may equate to radii of 40 ft. to 20 ft. (12.2 m to 6.1 m), respectively. The length of the lateral section may vary between 200 ft. and 900 ft. (60 m to 275 m) in some embodiments. In some embodiments, short-radius wells may be drilled with specialized drilling tools and techniques. A short-radius horizontal well may be drilled as a re-entry from any existing well.

Boreholes, which branch off, or deviate, from a main wellbore are sometimes referred to as sidetracked, deviated, or lateral boreholes. An example deviated borehole 14 is shown in dashed lines in FIG. 1. These boreholes may be capable of increasing the production output of the wellbore 14 as they may be directed toward different targets within the surrounding formation or may be drilled to bypass a collapsed wellbore, an obstructed wellbore, or for any number of other reasons. Additionally, in order to transition from vertical toward horizontal (or vice versa), or otherwise branch off the wellbore 14, a wall of the wellbore 14 may be penetrated by drilling therethrough when the wellbore 14 (or the location of the deviated borehole 15) is openhole. Where the wellbore 14 is cased at the location of the deviated borehole 15, the wall of the casing 22 may be penetrated by milling therethrough. This deviation from the main wellbore is known as wellbore departure.

Penetrating the cased wall of the wellbore 14 is one of many milling operations and may be referred to as milling or milling out. As opposed to drilling with a drill bit, milling refers to using a mill or mill bit (e.g., bit 20 of FIG. 1) to cut, grind, remove or otherwise degrade material from a wellbore. When milling, the material removed from, or degraded within, the wellbore 14 is often non-earth material (e.g., metal from the casing, cement, etc.). Materials to be milled may also include plugs or any other plugging material used to prevent loss of fluid into permeable zones within a wellbore. The plugs or plugging material may include cement, rubber, brass, composite materials, or any other material known in the art.

Some examples of milling operations or procedures include milling through one or more casing layers and/or cement surrounding the casing layer(s) to create a window 17, milling through the window 17 and wall of a wellbore to create one or more sidetracked, deviated boreholes branching off from the wellbore 14, and milling through casing 22 to remove a length of the casing 14 during a well abandonment or plugging process.

The BHA 18 may also be used to perform other downhole operations in addition to, or instead of, drilling or milling. For instance, the BHA 18 may be used to enlarge or shape the wellbore 14 or the casing 22 though an operation known as reaming. Reaming may include a BHA having reamers that cut or forcibly move any combination of earth and non-earth material to shape or enlarge the wellbore and/or casing. In some embodiments, reaming may be used to enlarge a portion of a previously drilled wellbore 14 or deviated borehole 15.

Yet other downhole operations may include the removal of fish (i.e., anything remaining in a wellbore, e.g., scrap metal, tools, drill pipe, drill collars, bit nozzles, etc.) from the wellbore 14.

In some instances, milling procedures, may be performed with a window mill. The bit 20 may be a window mill, and may include a plurality of individual blades coupled to a mill body. The mill body may be coupled to an end of a drill string in a milling BHA. The blades may rotate about an axis extending longitudinally through the center of the mill body and potentially the drill string. The blades may include cutting elements having cutting surfaces. One or more nozzles in the blades or the mill body may facilitate the circulation of fluid in the wellbore 14 during a milling operation with the window mill. A window mill is, however, just one example of a mill that can be utilized in a milling BHA and can be used in a corresponding milling procedure.

Other examples of mills that can be utilized in BHAs and milling procedures include section mills, pilot mills, tapered mills, junk mills, cement mills, dress mills, follow mills, window mills, tapered window mills, dress mills, watermelon mills, drill-mills, rotary steerable mills, casing mills, and so forth. In some embodiments, multiple mills may be used on the same BHA. For instance, a bi-mill configuration may utilize a window mill at a downhole end portion of the BHA. A follow mill may be located uphole of the window mill. The follow mill may also include a plurality of blades which can rotate (e.g., rotate as the BHA rotates). The follow mill may rotate with the window mill in some embodiments. Another configuration may be a tri-mill configuration in which an additional mill (e.g., a dress mill or watermelon mill) is included above the follow mill on the BHA.

When milling a window 17 in the casing 22, the whipstock 13 (shown in dashed lines in FIG. 1) may be used. A whipstock, which is also referred to herein as a 'whip,' is a wedge-shaped tool having at least one inclined surface. The whip may be formed of a high strength material such as steel, titanium, tungsten carbide, or the like. In some embodiments, the whipstock 13 may be anchored in the wellbore 14 to facilitate a wellbore departure procedure. When the bit 20 is moved downhole and into contact with the whipstock 13, the inclined surface(s) of the whipstock 13 may deflect the bit 20 into the casing (or wellbore wall for an openhole wellbore) to initiate formation of the deviated borehole 15.

Figure 2:
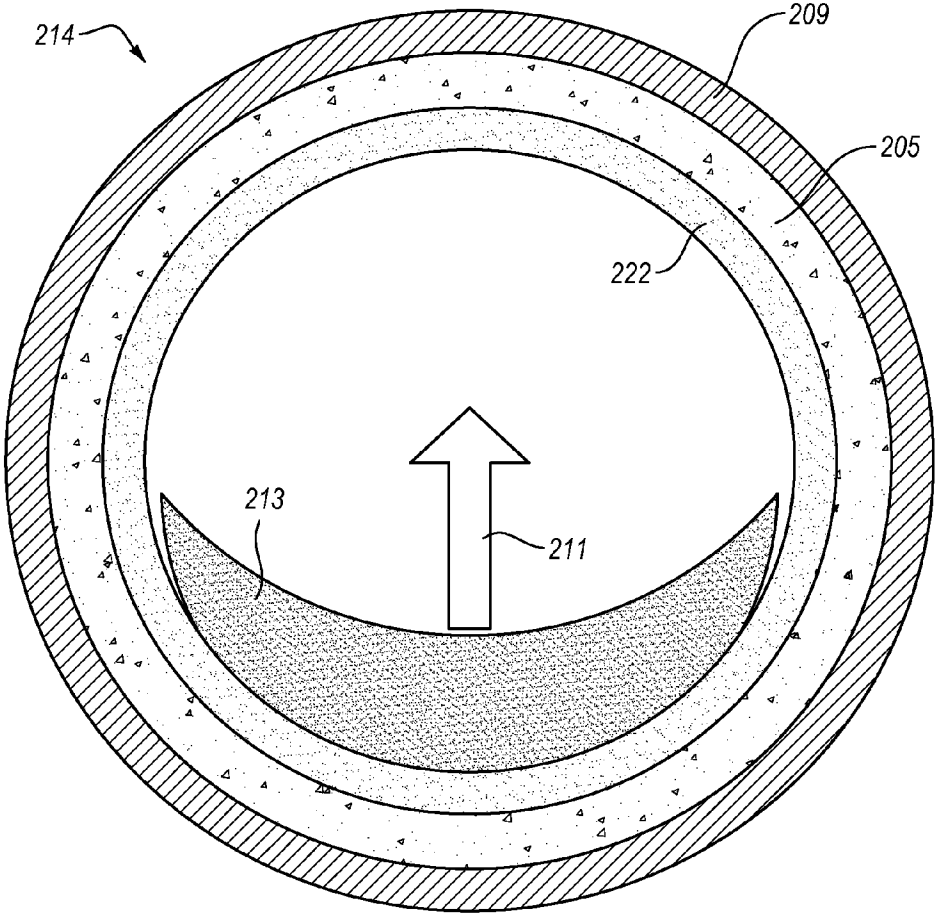
FIG. 2 is a cross-sectional view of a wellbore with a whipstock therein, in accordance with one or more embodiments of the present disclosure.

FIG. 2 is a cross-sectional view of a wellbore 214 with a whip 213 positioned therein. The whip 213 may be placed downhole and anchored at a predetermined position within a casing 222. The casing 222 may be surrounded by cement 205 within an annulus between the outer surface of the casing 222 and a wall of the wellbore 214 drilled through an earth formation 209. The whip 213 may be used to guide a BHA through the casing 222 by gradually directing/pushing the BHA in the direction of arrow 211 (i.e., radially against the casing 222, cement 205, and eventually the wall of the earth formation 209). During this process, although the BHA may remove a portion of the casing 222 (or of the earth formation 209), the BHA may also remove material from the whip 213, resulting in deformation of the whip 213.

In addition, when milling out casing 222, the intent may be to cut, grind, or otherwise form a window through the side of the casing 22 so that a sidetracked borehole may be formed through the window. The window may extend partially around the circumference of the casing 222, and axially along a portion of the length of the casing 222. The window size, shape, and other properties may affect what components of a BHA may be used when forming sidetracked boreholes. For instance, the smaller the diameter of a window, the smaller the gauge diameter of a drill bit, stabilizer, or other BHA component may be that will fit through the window. The window size may also help determine a maximum allowable dogleg severity (DLS). DLS is a measure of the amount of change in the inclination and/or azimuth of a sidetracked borehole, and is usually expressed in degrees per 100 ft. of course length. In the metric system, it is usually expressed in degrees per 30 m or degrees per 10 m of course length.

As will be appreciated by one skilled in the art having the benefit of the disclosure herein, selecting an appropriate whip and milling tool for performing wellbore departures and other milling procedures may improve the likelihood of a desired result and quality window formation, as well as restrict, and potentially prevent, failure of the whip and/or milling tool(s).

In some embodiments, milling tool assemblies can extend more than a mile in length while being less than a foot (0.3 m) in diameter. The trajectory along which the BHA mills is known as the bit path or trajectory. This trajectory, in some instance, may be affected by a combination of torsional, axial, and lateral vibrations, as well as the formation materials, casing materials, and milling components. In particular, the BHA may be relatively flexible along its length and may vibrate when driven rotationally by a rotary table, top drive, or other component. Vibrations may also result from fluctuations in the WOB during milling and from the bit contacting surfaces having harder and softer portions that break unevenly. Although partial damping of vibration may result due to viscosity of milling fluid, friction of the drill pipe rubbing against the wall of the wellbore, energy absorbed in milling, and milling tool assembly impacting with wellbore, these sources of damping are typically not enough to suppress vibrations completely.

When the BHA bit trajectory deviates from the expected bit trajectory, due to vibrations, wear of the whip, wear of the bit, or for other reasons, the BHA is said to have a walking tendency and is commonly associated with a direction (e.g., left, right, east, or west) and may be measured with respect to a cross-section of the wellbore. For example, when milling out a window in casing using a whip, the expected bit trajectory may be the direction in which the whip guides/pushes the BHA through the casing. Should the BHA deviate from the expected bit trajectory, the BHA could be considered to have a tendency of walking to the right or left with respect to a cross-section of the wellbore, depending on the direction in which the BHA deviates. These walking tendencies affect the window shape, size, and position (and thus window quality), as well as the whip profile, among many other things.

In some embodiments, the aforementioned tendencies may be increasingly significant when dealing with directional wells. Successful milling operations may depend on the appropriate selection of milling tools, fluids, and techniques. Mills, or similar cutting tools, should be appropriate for the wellbore conditions and the materials to be removed (e.g., casing and cement vs. earth formation). The fluids should be capable of removing milled material from the wellbore, and the mill should form cuttings of a size/shape that may be carried by the fluids. Additionally, the techniques employed should be appropriate for the anticipated conditions in order to achieve operation objectives.

Some aspects of the present disclosure provide systems and methods for selecting, modifying, and analyzing the performance of different milling BHAs and milling BHA components to determine the possibility, probability, and degree of success or failure for the different milling BHA assemblies and components during anticipated milling procedures. Additionally, some embodiments also provide systems and methods for analyzing the performance of different milling BHAs against pre-selected criteria, against one another, against data acquired in the field, against other data, or against any combination of the foregoing. Such analysis may allow, for instance, different milling BHAs to be compared even before entering the wellbore to determine which milling BHA will provide greater rate of penetration, reduced wear or risk or failure, optimal window formation, and the like.

Some embodiments disclosed herein may improve an ability of a system user (e.g., an engineer) to optimize the build of a milling BHA and a plan for a particular milling procedure by enabling the user to efficiently interface with a simulation tool that is capable of any one or more of accessing, selecting, or modifying different parameters of an anticipated milling procedure, including milling performance parameters, milling tool parameters, whipstock parameters, wellbore casing parameters, other parameters, or any combination of the foregoing. For sake of clarity, a number of definitions are provided below.

"Wellbore parameters" may include the geometry of a wellbore and/or the formation's material properties (i.e., rock profiles and other geologic characteristics). Wellbore parameters also include the characteristics and path or trajectory of a wellbore in which the milling tool assembly may be confined, along with an initial wellbore bottom surface geometry. A wellbore trajectory may be straight, curved, or include a combination of straight and curved sections. As a result, wellbore path, in general, may be defined by defining parameters for each segment of the path. For example, a wellbore may be defined as having N segments characterized by the length, diameter, eccentricity/shape, inclination angle, and azimuth direction of each segment and an indication of the order of the segments (e.g., first, second, etc.). Wellbore parameters defined in this manner may then be used to mathematically produce a model of a path of an entire wellbore, or of the entire portion of the wellbore to be evaluated. Formation material properties at various depths along the wellbore may also be defined and used, including rock profiles and any other characteristics defining aspects of the subterranean formation surrounding the wellbore (e.g., material type, hardness, formation type, etc.). In this regard, wellbore parameters can include or be referred to, in some instances, as "formation parameters."

Wellbore parameters can also include dip angle (i.e., the magnitude of the inclination of the formation from horizontal) and strike angle (i.e., the azimuth of the intersection of a plane with a horizontal surface) of the wellbore. One of ordinary skill in the art will appreciate in view of the disclosure herein that wellbore parameters may include additional properties, such as friction of the walls of the wellbore, casing and cement properties, and wellbore fluid properties, among others, without departing from the scope of the disclosure.

In some embodiments, formation parameters may be obtained by conducting physical tests. For instance, a cutting element in a test set-up may be physically scraped against rock samples of different types of formations. The cutting element may follow a circular or arcuate path while scraping the rock sample, or a linear test may be used. The test set-up may measure properties such as forces on the cutting element, volume of material removed, and the like. For instance, the cutting force and/or axial force may be measured during the test and stored in a file as a formation parameter. Similarly, the volume of rock removed per distance over time may be measured. The wear rate of the cutting element may also be measured and/or correlated with the data on volume of rock removed. Corresponding data may be obtained for various different axial forces applied on the cutting element. Example data that may be collected and/or stored is described in U.S. Pat. No. 8,185,366, which is incorporated herein by this reference in its entirety.

"Milling tool parameters," which can also be referred to as "BHA parameters" may include any one or more of: the type, location, or number of components included in the milling tool assembly; the length, internal diameter of components, outer diameter of components, weight, or material properties of each component; the type, size, weight, configuration, or material properties of the milling tool assembly; or the type, size, number, location, orientation, or material properties of cutting elements on milling tools. Milling tool parameters can also include "mill parameters," including one or more of: mill type; size of mill; shape of mill; blade geometry; blade position; number of blades; blade type; nozzle number; nozzle locations; nozzle orientation; type of cutting structures on the mill; cutting element geometry; number of cutting structures; or location of cutting structures. As with other components in the milling tool assembly, the material properties of the mill (including the mill body and the blades) and cutting elements may be defined for use in analyzing a mill and a milling tool assembly. Milling tool parameters can also include material properties used in designing or analyzing a milling tool, for example, the strength, elasticity, and density of the material used in forming the milling tool, as well as any other configuration or material property of the milling tool, without departing from the scope of the disclosure.

"Bit parameters," corresponding to one or more bits used in a milling BHA, can also be included as a subset of the milling tool parameters, and can define any characteristic(s) of the one or more bits.

"Milling operating parameters" may include one or more of: the type or parameters of the rotary table (or top drive mechanism); the speed at which the milling tool assembly is rotated (e.g. in revolutions per minute); surface rotational speed; the downhole motor rotational speed (if a downhole motor is included); the hook load; or the weight-on-bit. Milling operating parameters may further include milling fluid parameters, such as the type of the milling fluid, and the viscosity and density of the milling fluid, for example. It should be understood that milling operating parameters are not limited to these parameters. In other embodiments, milling operating parameters may include other parameters, such as rotary torque and/or milling fluid flow rate. Additionally, milling operating parameters for the purpose of milling simulation may further include the total number of mill bit revolutions to be simulated, the total distance to be milled, the total milling time desired for milling simulation, the trajectory of a milling operation, other milling parameters, or some combination of the foregoing.

Milling performance may be measured by one or more "milling performance parameters," examples of which may include: rate of penetration (ROP); rotary torque to turn the milling tool assembly; rotary speed at which the milling tool assembly turns; milling tool assembly lateral, axial, or torsional vibrations and accelerations induced during tripping or milling; weight-on-bit (WOB); forces acting on components of the milling tool assembly; or forces acting on the mill bit or components of the mill bit (e.g., on blades and/or cutting elements). Milling performance parameters may also include the inclination angle and azimuth direction of the sidetracked borehole being milled, dog leg severity, build up rate, window quality (i.e., size, position, and shape of the window), whip profile (i.e., the cross-sectional shape and area of the whip for one or more sections of the whip) after milling; bit trajectory; drill string deformation; whipstock deformation; walk rate or walking tendency; bending moment; von Mises stress; or bit geometry. One skilled in the art will appreciate, in view of the present disclosure, that other milling performance parameters exist and may be considered without departing from the scope of the disclosure.

"Whipstock parameters" may include one or more whip dimensions or parameters, including diameter and length, as well as one or more profile dimensions (e.g., cross-sectional shape and area), slope of one or more inclined surfaces of the whip, as well as material properties of a whip (e.g., size, weight, hardness, and material composition) for any section, or for each section, of the whip. In some embodiments, whipstock parameters may be included in, or be associated with, a file including data obtained from a physical test. For instance, a cutting element in a test set-up may be physically scraped against samples of different whipstock materials (e.g., different types of steel). The cutting element may follow a circular or arcuate path while scraping the material sample, while in other embodiments the physical data may be obtained from a linear scrape test. Optionally, the linear scrape test may be performed at a higher speed than a rotational scrape test used for measuring properties of different rock or formation materials. In the rotational or linear scrape test, the test set-up may measure properties such as forces on the cutting element, volume of material removed, and the like. For instance, the cutting force and/or axial force may be measured during the test and stored in a file as a whipstock parameter. Similarly, the volume of material removed per distance over time may be measured. The wear rate of the cutting element may also be measured and/or correlated with the data on volume of material removed. Corresponding data may be obtained for various different axial forces applied on the cutting element. Example data that may be collected and/or stored is described in U.S. Pat. No. 8,185,366, which was previously incorporated herein by this reference in its entirety.

"Wellbore casing parameters" may include one or more dimensions or other parameters associated with a casing, including diameter, length, and thickness, as well as material properties of the corresponding casing (e.g., type, structure, weight, hardness, and material composition) for any or all sections of the corresponding casing. Wellbore casing parameters may also define a depth or axial location of the casing within a wellbore, type and geometry of casing couplings, a quantity of nested casings, or radial spacing between nested casings. In some instances, the properties and characteristics of a cement layer positioned between casings and/or between a casing and the surrounding earth formation can also be defined by wellbore casing parameters. Optionally characteristics and spacing between the wellbore wall and the outer circumference of the cement may be defined by the wellbore casing parameters.

In some embodiments, wellbore casing parameters may be included in, or be associated with, a file including data obtained from a physical test. For instance, a cutting element in a test set-up may be physically scraped against samples of different casing materials (e.g., different types of steel for casings, liners, couplings, etc.). The cutting element may follow a circular or arcuate path while scraping the material sample, while in other embodiments the physical data may be obtained from a linear scrape test. Optionally, the linear scrape test may be performed at a higher speed than a rotational scrape test used for measuring properties of different rock or formation materials. In the rotational or linear scrape test, the test set-up may measure properties such as forces on the cutting element, volume of material removed, and the like. For instance, the cutting force and/or axial force may be measured during the test and stored in a file as a wellbore casing parameter. Similarly, the volume of material removed per distance over time may be measured. The wear rate of the cutting element may also be measured and/or correlated with the data on volume of material removed. Corresponding data may be obtained for various different axial forces applied on the cutting element. Example data that may be collected and/or stored is described in U.S. Pat. No. 8,185,366, which was previously incorporated herein by this reference in its entirety.

"Simulation parameters" may include any of the foregoing parameters that are used to control or direct a simulation of a milling procedure. For instance, simulation parameters may include the milling operating or performance parameters, the whipstock parameters, the wellbore casing parameters, or any combination of the foregoing. Simulation parameters may also define outputs or metrics associated with milling simulations, including but not limited to a quantity and type of outputs to render at any particular time(s). In some embodiments, the simulation parameters may include additional types of parameters or components. For instance, plug parameters associated with a cement plug, bridge plug, or the like may be included within simulation parameters. Fish parameters associated with downhole tools, debris, or other fish within a wellbore may also be included within simulation parameters.

As used herein, a "milling simulation" is a dynamic simulation of a BHA used in a milling operation. The milling simulation may be referred to herein as being "dynamic" because the milling is a "transient time simulation," meaning that it is based on time or the incremental rotation of the milling tool assembly. For the purposes of calibrating a model and having a baseline for potential solutions, a milling simulation using any of the foregoing parameters may be used. The milling simulation may be performed with finite element analysis and other simulation algorithms. In some embodiments, the finite element analysis may use parameters defined, selected, or otherwise modified at a user interface, parameters accessed through one or more files (e.g., formation, whipstock, casing, fish, or other parameters obtained from a scrape test), other parameters, or any combination of the foregoing.

In a broad context, the term "milling components" can refer to any combination of the aforementioned components and parameters associated with milling procedures that are utilized by the systems, storage devices, methods and interfaces of the disclosure provided herein.

In one or more embodiments, a simulation may provide visual outputs or other indicia of performance parameters. Further, the outputs may include tabular data of one or more performance parameters. In addition, the outputs may be in the form of one or more of graphs, charts, or logs of a performance parameter, with respect to time, or with respect to location along the BHA, for example. When the outputs are given based on location along the BHA, the outputs may be presented as an average value for each location, or using other percentages, such as 5%, 10%, 25%, 75%, 90%, and 95%. P5%, P95%, P50%, etc. may be statistical representations of a variable. For example, given a history of axial acceleration, a statistical distribution of all the points may be determined. P5% means that 5% of the points are below the value or number, while P95% means 95% of the points are below the value or number.

Other outputs and plots, in some embodiments, include presentations or visualizations of the results at a minimum or maximum value, at a given location, over a period of time, or any combination of those results. Graphical visualizations of a mill or other bit, drill string, milling tools (e.g., a section mill or casing mill), downhole tools (e.g., a hole opener or reamer), milling tool assembly, other tools or assemblies, or some combination of the foregoing, may also be output. Graphical visualizations in 2-D, 3-D, or 4-D may include color schemes for the whip, the mill, the drill string, or any BHA (or BHA components) to indicate performance parameters at different locations on the corresponding milling assembly or during a milling procedure.

Outputs, in some embodiments, also include animations composed of a plurality of images sequenced together or that overlap. Animations can be run in real-time during simulation processing. Animations can also be rendered after the simulation processing and analysis is complete.

In some instances, simulation outputs also include aural output that may amplify or complement corresponding visual output. The aural output may also correspond with real-world sounds that are typically associated with different milling-related functions (e.g., scraping, grinding, tearing, seizing, and so forth) and sounds of milling different materials (e.g., casing wall, formation, cement, and so forth). In the same or other embodiments, the simulation outputs include haptic feedback that may further complement other simulated output.

The parameters that are considered during a simulation analysis can be accessed and input in different ways. In some embodiments, the parameters are accessed from one or more stored files, such as milling tool files, whipstock files, wellbore casing files, simulation parameter files, rock/formation files, and so forth. In other instances, a single file may contain a collection of different types of parameters that are associated with a plurality of different corresponding milling components, including milling tool parameters, whipstock parameters, wellbore casing parameters, milling operating parameters, other parameters, or combinations thereof.

In some embodiments, parameters are entered and/or modified manually through one or more simulation or milling interfaces. In the same or other embodiments, parameters are obtained from actual field data or sensors associated with one or more BHA components. The field data can, in some instances, be obtained before, during, or after a simulation. For instance, field data can be obtained prior to a simulation and considered in real-time during the simulation to compare against, calibrate, or tune simulations to attempt to match actual field data.

Figure 3:
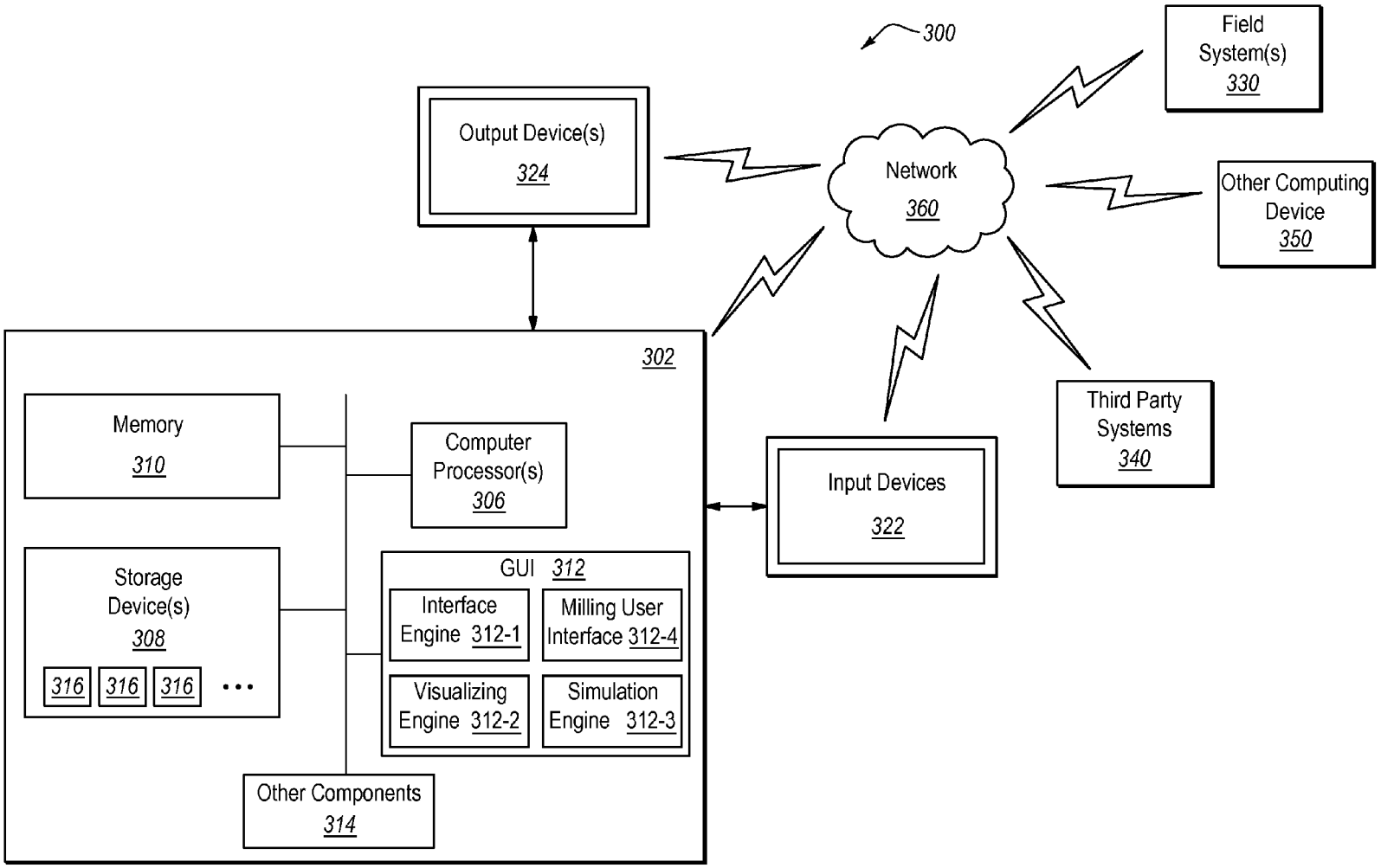
FIG. 3 shows a computing environment that can be used for simulating downhole milling operations, in accordance with one or more embodiments of the present disclosure.

Attention will now be directed to FIG. 3, which schematically depicts a computing system 300 which may be used for accessing, selecting, or modifying the aforementioned parameters, or for performing any combination of the foregoing. The computing system 300 may be used to perform other functionality described herein for facilitating at least the simulation of one or more milling procedures. It will be noted, however, that the illustrated embodiment of FIG. 3 is merely an example embodiment, such that the illustrated elements may be omitted, repeated, substituted, or combined with one or more other elements, in certain embodiments, without departing from the scope of the present disclosure.

The illustrated computing system 300 of FIG. 3 includes a computing device 302 having one or more computing processors 306 (e.g., a central processing unit (CPU), a graphics processing unit (GPU), and other hardware processors), one or more storage devices 308 (e.g., a hard disk, an optical drive such as a compact disk (CD) drive or digital versatile disk (DVD) drive, a flash or solid state drive or storage device, and/or other hardware storage devices), memory 310 (e.g., random access memory (RAM), read only memory (ROM), cache memory, flash memory, etc.), a graphical user interface (GUI) 312, and other components 314 (e.g., graphics cards, network interface cards (NICs), communication bus, etc.).

In some embodiments, the computing processor(s) 306 may include integrated circuits for processing or executing computer-executable instructions that are stored in the storage device(s) 308 or memory 310 for implementing the methods and functionality disclosed herein. These processor (s) may include one or more core processor(s) and/or micro-core processor(s).

The storage device(s) 308 (and/or any information stored therein) may include a data store such as a database, a file system and/or one or more data structures (e.g., arrays, link lists, tables, hierarchical data structures, relational data structures, etc.) which are configured for computer storage. The data may be stored in any suitable format (e.g., as an extensible markup language (XML) file, a standard generalized markup language (SGML) file, hypertext markup language (HTML) file, or any other suitable storage format).

The storage device(s) 308 may include one or more devices internal to the computing device 302 and/or one or more external storage devices operatively connected to the computing device 302 (e.g., via a port, connector, network interface, etc.).

In some instances, the storage device(s) 308 store one or more files 316. The files 316 may include files as discussed herein, and in some embodiments may contain milling tool parameters specifying characteristics of one or more virtual milling tools, whipstock parameters specifying characteristics of one or more virtual whipstocks, wellbore casing parameters specifying characteristics of one or more virtual wellbore casings, milling operation parameters specifying characteristics of one or more milling procedures, other parameters, or any combination of the foregoing. These parameters can be stored separately in the storage device(s) 308 as separate files 316 or together as one or more composite files. Milling tools, whipstocks, and wellbore casings may be referred to as "virtual" when parameters thereof may be used in a simulation of a milling procedure. Virtual parameters may, however, be based on physical tools or devices in some embodiments.

The stored files 316 can also include files storing simulation parameters that control how a simulation is run (e.g., algorithms to be applied, simulation iterations, simulation comparisons, simulation inputs and outputs, and so forth). Actual simulation data can also be stored in the storage device(s) 308. Actual field result data can also be stored in the storage device(s) 308.

The GUI 312 may include various specialized computing engines for facilitating the methods and functionality disclosed herein. These specialized computing engines may include, for example, an interface engine 312-1, a visualizing engine 312-2, and a simulation engine 312-3. These engines may be instantiated and/or implemented by the computer processor(s) 306.

The interface engine 312-1 is usable to access one or more of the files 316 containing any of the aforementioned parameters, as well as to generate a milling user interface 312-4 that displays interactive elements that are operable (e.g., in response to user input or automated processing) for selecting and/or modifying the parameters. In particular, the GUI 312 may include any combination of display objects such as buttons (e.g., radio buttons, link buttons, etc.), data fields (e.g., input fields), banners, menus (e.g., user input menus), boxes (e.g., input or output text boxes), tables (e.g., data summary tables), sections (e.g., informational sections or sections capable of minimizing/maximizing), screens (e.g., welcome screen, home screen, data screen, login/logged out screen), user selection menus (e.g., drop down menus), or other components, or some combination of the foregoing.

In the same or other embodiments, the GUI 312 may include one or more separate interfaces and may be usable in a web browser as a service and/or as a standalone application. The GUI 312 may include program code or other modules (e.g., stored in storage device(s) 308 and/or memory 310) that may be executed by the computer processor(s) 306 to provide interfaces for input and/or output by a user.

The visualizing engine 312-2 is usable to generate a visual representation of actual or virtual milling tool(s), whipstock (s), wellbore casing(s), any other BHA or wellbore component(s), or any combination of the foregoing. In some embodiments, the visual representations accurately reflect the milling BHA and wellbore components based on the aforementioned parameters that were accessed, selected, or modified. The components can be visualized separately and/or in an assembly by the milling user interface 312-4.

In accordance with some embodiments, the GUI 312 may be operated by a user (e.g., an engineer, a designer, an operator, an employee, or any other entity) using one or more input devices 322, and the GUI 312 may be visualized using one or more output devices 324 coupled to the computing device 302. The GUI 312 may also access and display data stored in the storage device(s) 308 or memory 310, as well as output that is generated as a result of the simulations.

The input device(s) 322 may include any number of components. For instance, the input device(s) 322 may include any combination of touchscreen, keyboard, mouse, microphone, touchpad, electronic pen, field sensor, camera, or other types of input device.

The output device(s) 324 may also include number of components. For instance, the output device(s) 324 may include any combination of one or more screens or other displays (e.g., a liquid crystal display (LCD), plasma display, light emitting diode (LED) display, touchscreen, cathode ray tube (CRT) monitor, projector, 2D display, 3D display, or other display device), a printer, speaker, haptic feedback device, external storage, or other output devices.

One or more of the output device(s) 324 may be the same or different from the input device(s) 322. The input and output device(s) 322, 324 may be locally or remotely connected to the computer device 302 through wired and/or wireless connections.

In some embodiments, the computing system 300 may also include one or more remote computing devices or systems. These remote devices and systems can include sensor and field systems 330 that are monitoring or that are otherwise connected to a BHA being used in the field, and/or one or more third party systems 340, such as clearinghouse systems or remote databases containing stored data accessed by the computing device 302 to perform one or more of the disclosed functions.

While the computing device 302 is shown as a single device, it will be appreciated that in other embodiments, the computing device 302 is actually a distributed computing system that includes the computing device 302 and one or more other computing devices 350 that each have their own hardware processor(s). In such a distributed computing environment (such as a cloud computing environment), the different computing components (e.g., memory 310, storage device(s) 308, GUI 312, and other components 314) can be shared and/or distributed in any way among the plurality of different computing devices 350.

The computing device 302 may be communicatively coupled to any combination of the foregoing computing systems and devices through a network 360 (e.g., a local area network (LAN), a wide area network (WAN) such as the Internet, mobile network, or any other type of network) through one or more network interfaces that include any combination of one or more wires, cables, fibers, optical connectors, wireless connections, network interface connections, or other network connections.

The aforementioned computing devices and systems may take various forms and configurations, including, physical servers, virtual servers, supercomputers, personal computers, desktop computers, laptop computers, message processors, hand-held devices, programmable logic machines, multi-processor systems, microprocessor-based or programmable consumer electronics, network PCs, tablet computing devices, minicomputers, mainframe computers, mobile telephones, PDAs, wearable computing devices, and the like.

In some embodiments, the computing device 302 and corresponding computing system 300 may be used to simulate a milling procedure performed by a milling BHA or milling component that is accessible and selected by a user from a pre-existing library of milling BHAs and milling procedures (e.g., stored on storage device(s) 308 as file(s) 316). For instance, a company may generate and maintain a log, journal, or other record of BHAs that have been used or designed in the past and any of these BHAs, among others, may be stored in the pre-existing library of BHAs. Selecting a BHA or BHA component from the pre-existing library of BHAs may be done by the user using the GUI 312 and/or input device(s) 322, executed by the computing processor(s) 306, and may be visualized or otherwise rendered with the appropriate output device(s) 324.

In the same or other embodiments, the BHA and BHA components may be created or customized by the user (e.g., using the GUI 312). The user may create or customize any milling procedure component(s), for example, by inputting, selecting or modifying the components and/or their parameters with the GUI 312.

Additionally, any simulation of a milling procedure may be designed or customized by any combination of accessing, inputting, selecting, or modifying a variety of wellbore parameters, whipstock parameters, casing parameters, milling operating parameters, simulation parameters, other parameters, or combinations thereof with the GUI 312. For instance, the computing device 302 may present to the user a number of BHA components, whipstocks, and casings from a pre-existing library for selection. The user may select one or more BHA components to be included in the simulation. Based on the selection, a number of corresponding parameters may also be presented to the user via the GUI 312. In some embodiments, the user may instead, or additionally, modify a milling BHA or milling component based on particular milling operating parameters, wellbore parameters, or any other conditions known to a person having ordinary skill in the art in view of the disclosure herein. For example, a user may determine a desired WOB or ROP and may modify the milling BHA accordingly taking into account the desired WOB and/or ROP, among others using the GUI 312.

Various embodiments of some of the interfaces that can be provided by the GUI 312 are now described with reference to FIGS. 4-15. Aspects of the GUI 312 are generalized, such that it will be appreciated that the GUI 312 interfaces have elements that may be omitted, repeated, substituted, combined, added, or otherwise modified from what is explicitly shown. Accordingly, embodiments for presenting or utilizing the GUI 312 should not be considered limited to the specific arrangements the GUI 312 elements shown in FIGS. 4-15.

Figure 4:
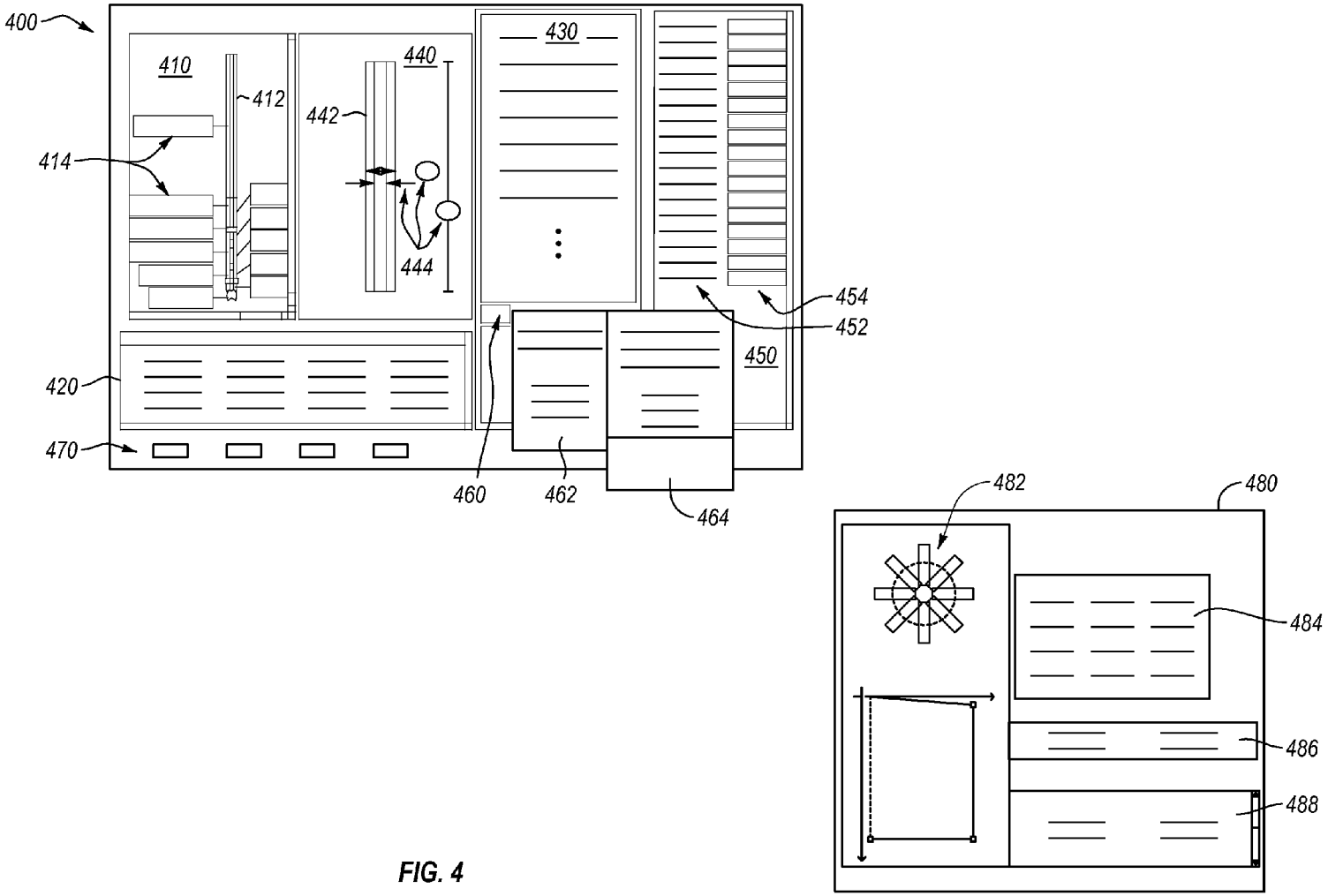
FIGS. 4-8 show graphical user interfaces for use in a system for simulating downhole milling operations, in accordance with one or more embodiments of the present disclosure.
Figure 5:
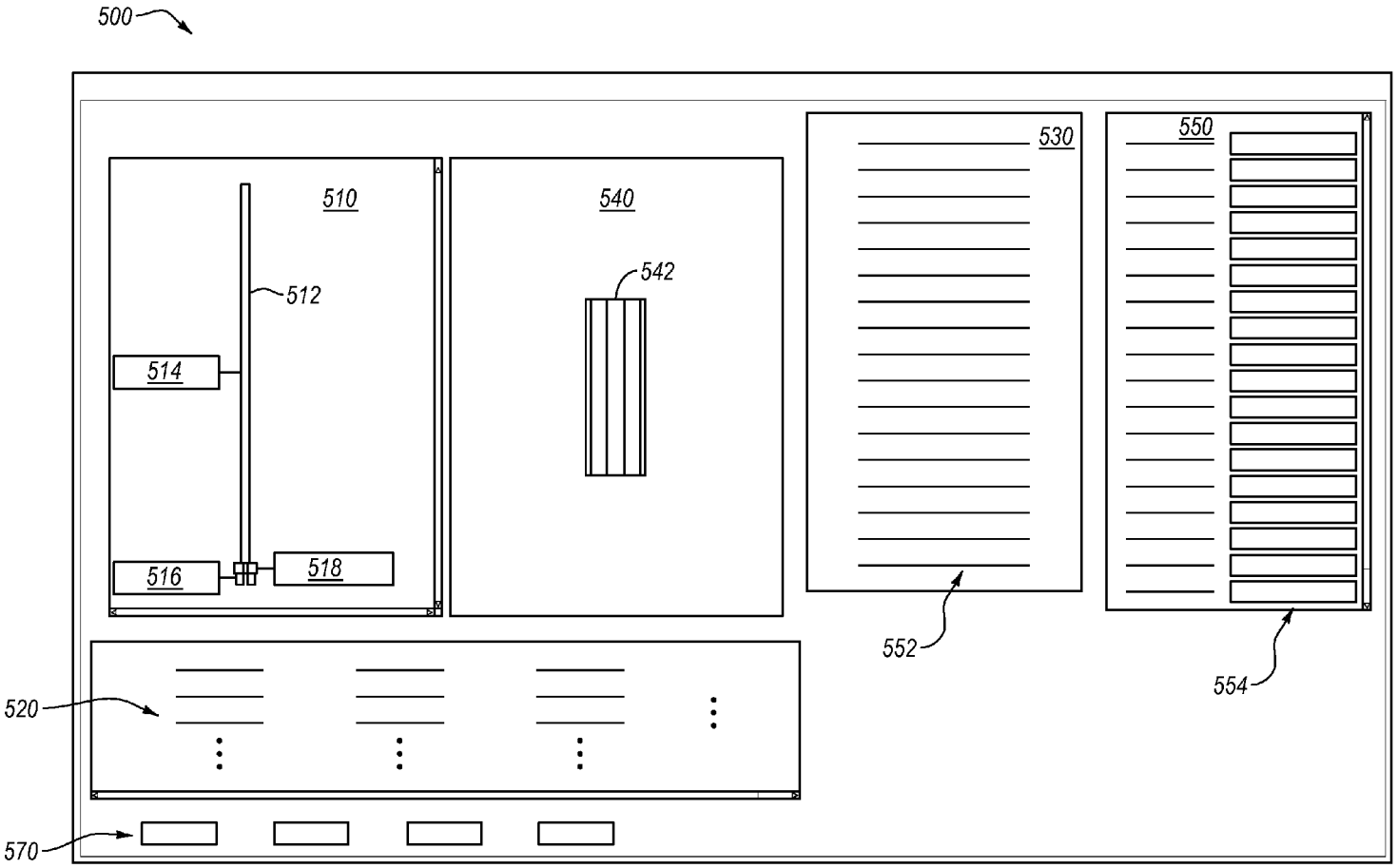

FIGS. 4 and 5 illustrate interfaces of the GUI 312 that include optionally selectable elements that are operable for creating, accessing, selecting, modifying, or otherwise customizing or specifying a milling BHA or milling BHA component.

In FIGS. 4 and 5, an engineer, BHA designer, field technician, or other user may input series of information about a BHA and various selected components of the BHA and drill string, including bits/mills, and other milling tool assembly components.

As shown in FIG. 4, an interface 400 of the GUI 312 (FIG. 3) may include a milling BHA view 410 showing a milling BHA 412 that is currently being designed, selected, visualized, or simulated. The BHA 412 is illustrated with optional detailed callouts 414 that identify and provide parameter information for some of the different BHA components that are illustrated. The particular components illustrated, however, should not be viewed as limiting the scope of this disclosure and can, therefore, include any BHA milling components (e.g., lead mill and other mills (e.g., window mill, taper mill, dress mill, follow mill, dress mill, watermelon mill, drill-mill, junk mill, rotary steerable mill, section mill, casing mill, etc.), drill collars, stabilizers, MWD/LWD tools, downhole motors, jars, drill pipes, transition drill pipes, vibration dampening tools, vibration inducing tools, shock subs, stabilizers, cross-overs, circulation subs, disconnect subs, and so forth). Indeed, in some embodiments, a full length of a drill string and each component of the BHA may be specified and identified in the BHA view 410 and/or illustrated as BHA 412.

In some embodiments, for example, the BHA will include a bi-mill having a lead mill and a follow mill. In another embodiment, the BHA will include a tri-mill having a lead mill, a follow mill, and a dress mill. Each component includes parameters that are selectably modifiable by a user to control the corresponding simulation and visualization of each corresponding component. One or more stabilizers, drill collars, and the like may also be specified as part of the bi-mill, tri-mill, or other milling BHA.

The interface 400 also includes a data listing 420 that includes a detailed listing of one or more specific types of a milling component that is identified in the BHA 412 and that is selectable from a component listing 430, which includes a plurality of listed and selectable milling components (e.g., milling tools, whipstocks, casings, etc.). Parameters of the listed milling components can also be visualized within the data listing 420.

When a component is selected from the component listing 430, a visualization of the component can be presented in a separate window, like window 440, which is presently visualizing a drill collar 442. Dimensions or other parameters of the visualized component(s) in window 440 can also be called out in one or more references 444. The specific parameters, including dimensions and material properties of the selected component(s) are also displayable in another window frame, such as frame 450.

Frame 450 is presently used to list a plurality of parameters 452 and input fields 454 that are operable to receive user input for entering or modifying any of the parameters 452. When a parameter is modified or entered, the GUI 312 (FIG. 3) modifies the visualization in 440 and/or the parameters listed in the data listing 420.

If a desired component is not presently listed in the component listing 430, it may be possible to access additional milling components by selecting an object like object 460 to access supplemental category listing 462 or supplemental subcategory component listing 464 (which is accessible by selecting a category from one or more listed categories in category listing 462).

Additional interface objects may also be presented, like objects 470, which are selectable to save or select a displayed/listed milling component for a subsequent simulation of a milling process or for inclusion into a milling BHA.

Objects 470 can also be provided for accessing one or more additional interfaces for viewing, modifying, or saving milling components. For instance, an object 470 may be used to access interface 480, which is presently illustrating aspects of a casing mill tool, along with a visualization window 482 showing visualizations associated with the milling tool. The visualizations in the visualization window 482 may be based on parameters for the corresponding component. In FIG. 4, the visualization window 482 shows multiple views of the casing mill tool, and features such as the number of blades, orientation of the blades, shape of the blades, thickness of the blades, body size, and the like may be visualized. The specified or identified parameters used in producing the visualization in visualization window 482 may be found, for instance, in one or more milling tool parameter windows 484, 486, and 488, which can be used to view, select, enter, modify save, or otherwise interact with one or more corresponding milling tool parameters associated with the visualized milling tool. In some embodiments, the additional interface 480 is accessible through supplemental subcategory component listing 464.

FIG. 5 illustrates a similar interface 500 to the interface 400 of FIG. 4. As shown, the interface 500 includes a milling BHA view 510 showing a milling BHA 512 that is currently being designed and visualized and/or simulated. As the BHA 512 is designed, additional components may be selected and added, components may be moved, components may be replaced, or components may be removed. The BHA view 510 may visually show changes to the BHA 512 as different components and parameters are specified.

The BHA 512 is also illustrated with various detailed callouts that identify and provide parameter information for some of the different BHA components. In this embodiment, the first call out 514 may be for a drill pipe, a second callout 516 may be for a taper mill, and a third callout 518 may be for a section mill. Each callout can include corresponding identifiers and/or parameters.

An example visualization of a drill pipe 542 for use in a drill string is shown in window 540. Any portion(s) of the milling components identified by the interface 500 can be visualized. In some embodiments, the visualization window 540 visualizes a component selected from the visualization in the BHA view window 510. In another embodiment a user is able to select a component for visualization from another frame, such as from a listing in frames 530 or 550.

The user can also select and modify listed parameters 552 with input fields 554 provided in frame 550 or one or more other locations, such as listing 520.

Each and every displayed object and listing can include a selectable object which, when selected, enables a user to provide additional input to modify a parameter and/or cause the corresponding milling component or milling assembly to be visualized and/or simulated.

FIG. 6 illustrates another non-limiting example of an interface 600 provided by GUI 312 (FIG. 3), which includes interactive elements that are operable, in response to user input, to access, select, modify, display, or otherwise interact with virtual whipstocks and whipstock parameters as well as virtual wellbore casings and wellbore casing parameters.

As shown, interface 600 includes various interactive elements, including selectable option 610 for selecting a whip. When option 610 is selected, the interface may display a listing of different whips to choose from and/or an option to define a new whip. In some embodiments, the listing may be populated according to one or more files containing whip parameters.

A selected whip may be displayed in visualization window 640 and corresponding whip parameters (e.g., whip diameter, conical surface type, cone angle, cone tip to whip tip distance, cut diameter, diameter, etc.) may be displayed as optionally interactive elements in window 630. A parameter can be modified by selecting one or more of the interactive elements in window 630 and adjusting the correspondingly displayed parameter by entering or modifying input into one or more input fields. Although not shown, each parameter can be displayed next to a descriptive parameter title or with other or additional reference indicia.

When the selected whip has several segments with different parameters, the plurality of different sections can be identified in a listing, such as listing 650, which lists the different parameters for each segment (e.g., slide/ramp angle, length, cut diameter, maximum thickness, concavity, etc.). Each of these parameters can be selected or modified as well, similar to the parameters of window 630.

The visualization window 640 can also illustrate the various whip segments of the whip 642, as well as corresponding casing, cement and other wellbore structures. In this visualization, there are two casings 644 and 646 with a cement layer 648 there between.

The casing and cement parameters (e.g., quantity, type, material, dimensions, etc.) are accessible, modifiable, selectable and otherwise visible with one or more interactive elements. For instance, element 660 which enables a user to specify whether the wellbore includes or excludes a casing. Likewise, window 670 displays wellbore casings and wellbore casing parameters and an interactive element 672 that enables a user to specify a number of wellbore casings to include. The positioning of multiple casings relative to each other may also be specified using window 670.

Window 680 contains parameters corresponding to wellbore assembly parameters (including cement layer parameters), which are selectable and modifiable to control the visualization of the wellbore assembly shown in window 640. In some embodiments, an interactive element 682 is provided that enables a user to selectively fill in space between wellbore casings with cement.

Window 680 also contains parameters that are selectably modifiable to control the centering of the different wellbore casings (646 and 648). Accordingly, in response to user input, casings 646 and 648 in visualization window 640 are not coaxially aligned, such that there is greater spacing between the casing walls on one side of the visualization than on the other.

It will be appreciated that the visualization of the selected component(s) can be rendered in different ways to illustrate different aspects of the selected component(s). In FIG. 6, the wellbore assembly in the visualization window 640 is illustrated as a cutaway side perspective of the two casings 644 and 646, a cement layer 648, and the whipstock 642. The visualization also includes a top cutaway view of with dimensional callouts and visualizations depicting dimensions of the whipstock (e.g., the cut diameter and cross-sectional shape).

Interface 600 also include an additional window 690 which may be opened in response to a user providing input selecting one of the interactive elements (e.g., display objects, listings, parameters, etc.) shown in the interface 600. This window 690 may, for instance, include a listing of different wellbore casings and wellbore casing parameters corresponding to at least an outer diameter of the wellbore casings. Upon selecting one of the listed wellbore casings, a new menu 694 may be provided for modifying the wellbore casing parameter (e.g., outer diameter) of a selected wellbore casing.

Any selected milling components and any modifications to the corresponding milling component parameters may be visualized in the visualization window 640. In some embodiments, as in FIG. 6, the milling component parameters include whipstock parameters, wellbore parameters, and wellbore casing parameters. In the same or other embodiments, the corresponding milling component parameters include simulation parameters, milling tool parameters, or milling operating parameters. It will be appreciated, therefore, that the corresponding milling component parameters can include any parameters of a milling tool or milling component that is visualized and/or defined by the GUI 312.

Various other interactive elements 670 may also be provided to enable a user to selectively access one or more files (or the parameters therein) containing data corresponding to milling components, and to save data corresponding to milling components and assemblies that have been selected, designed, or otherwise modified or defined by the user input.

Figure 7:
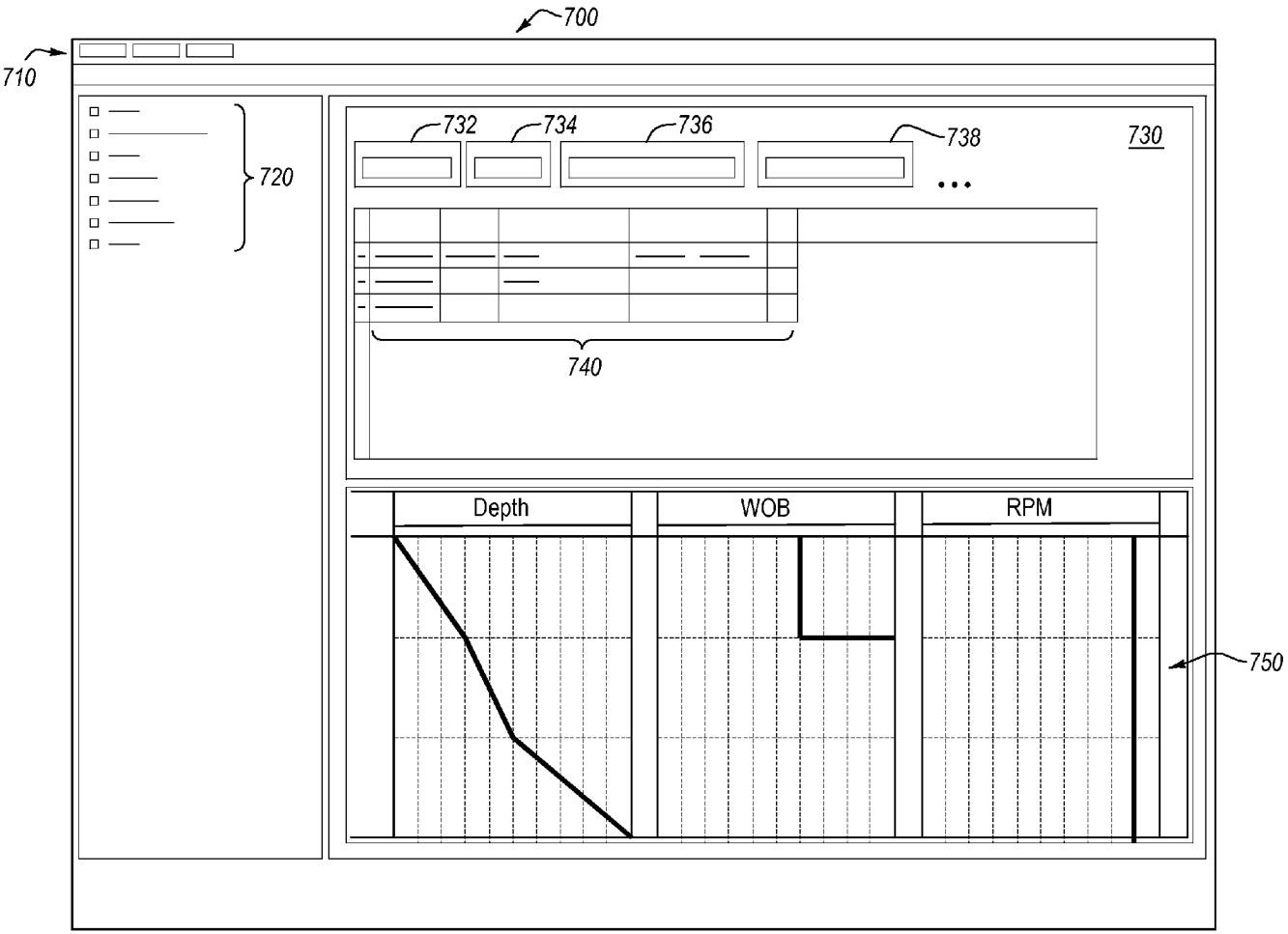

Simulation parameters can also be accessed, selected, modified, or otherwise used with one or more interfaces of the GUI 312 (FIG. 3). By way of example, interface 700 of FIG. 7 illustrates an embodiment of an interface for modifying milling simulation parameters (e.g., parameters that define milling operations and milling tool paths/trajectories, etc.).

The interface 700 includes various interactive elements 710, which may be similar to those previously discussed in reference to the interfaces in FIGS. 4-6. The interface 700 also includes a listing 720 of various categories of types of milling operations that can be performed. These selectable options, when selected, may cause the interface 700 to display corresponding milling or simulation parameters of an anticipated milling procedure. For instance, a selection of a milling category type from listing 720 can cause interface 700 to display interactive elements in window 730.

Window 730 includes interactive elements which are operable, in response to user input entered therein, to select or modify milling operating parameters. Example milling operating parameters that may be selected and/or modified in window 730 include milling depth (732), WOB (734), RPM (736), staring depth (738), and so forth. More detailed parameters for different milling phases can be broken out and defined with other interactive elements 740, as well, by selecting and/or entering information into the corresponding parameter input fields for each milling phase. Finally, visualizations of the simulation parameters can be presented to the user in one or more additional windows, such as window 750.

Figure 8:
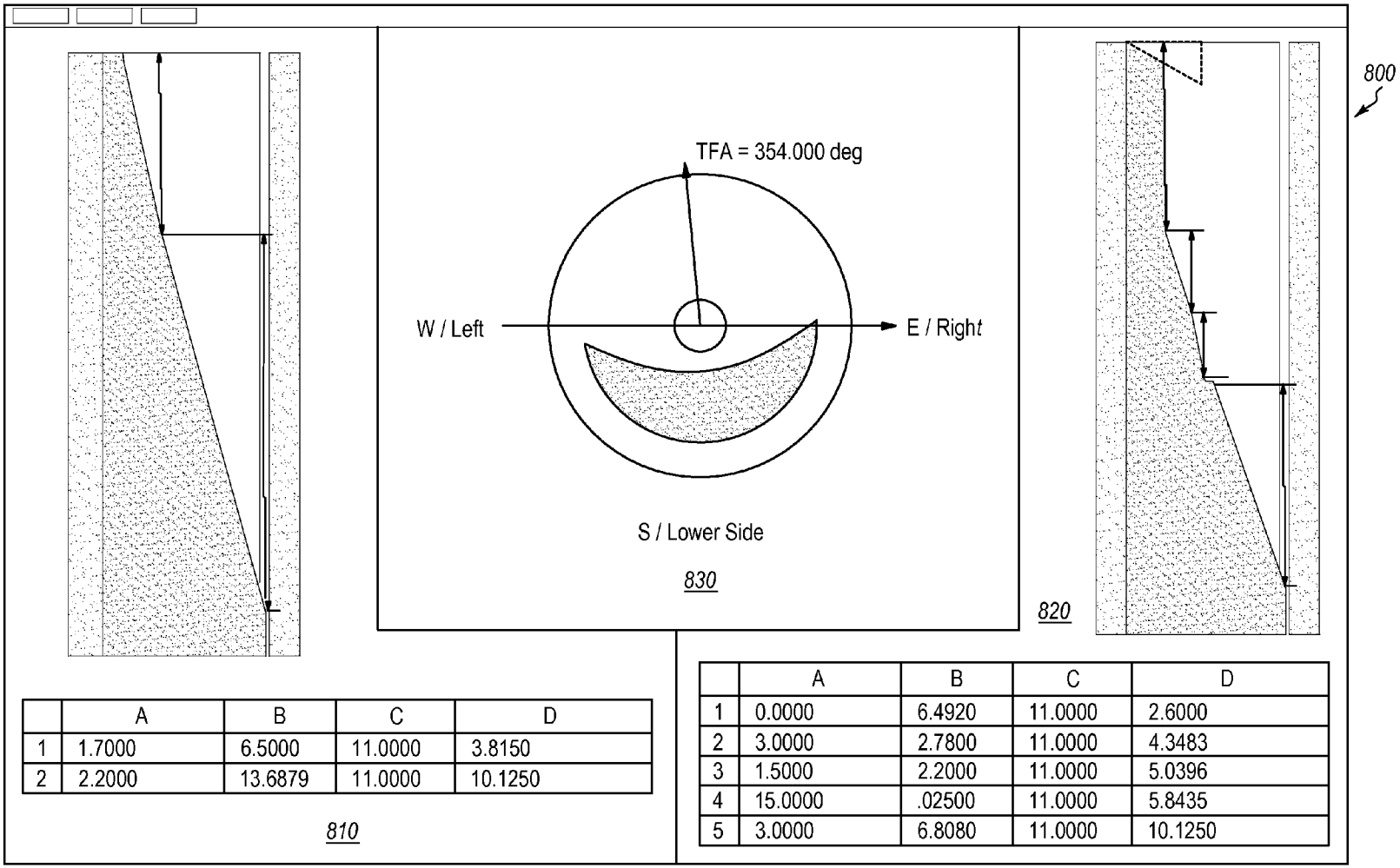

FIG. 8 illustrates another example of an interface 800 that includes windows 810, 820, and 830 that each contain visualizations of milling components and corresponding parameters that can be selected and/or modified for a simulation. In this particular embodiment, the interface 800 may be used to select, modify, or visualize one or more whipstocks; however, in other embodiments the interface 800 may be used for other components of a milling tool assembly. For instance, any component of a BHA (e.g., BHA 412 of FIG. 4) may be selected, modified, or visualized in the interface 800, or compared with another component of the BHA or a potential component for the BHA.

In this embodiment, the interface 800 may include a window 810 in which a whip having a single angle is visualized, along with corresponding parameters of the whip. Any number of types or categories of parameters may be used to generate the visualization, or displayed (e.g., as interactive elements). Window 810, for instance, illustrates four categories of parameters for two separate segments of the whip. Example categories may include, slide angle, length, cutaway diameter or concavity, maximum thickness, or the like. In window 820, a multi-ramp whip is visualized, along with corresponding parameters of the whip (e.g., for each segment of the whip). In window 830, a whip is illustrated in a top cutaway view showing the direction or angle that whip is configured to push a mill bit during a milling procedure. As discussed herein, each of these parameters can be selected and/or modified to change the corresponding visualizations. A whip visualized or otherwise specified in the interface 800 may also be selected as a virtual whip for use in simulating a milling procedure.

When a simulation is performed, the results of the simulation can be visualized or otherwise output in any number of forms. Example formats used to reflect an impact of a simulation are shown, for example, by the illustrations of FIGS. 9 and 10.

Figure 9:
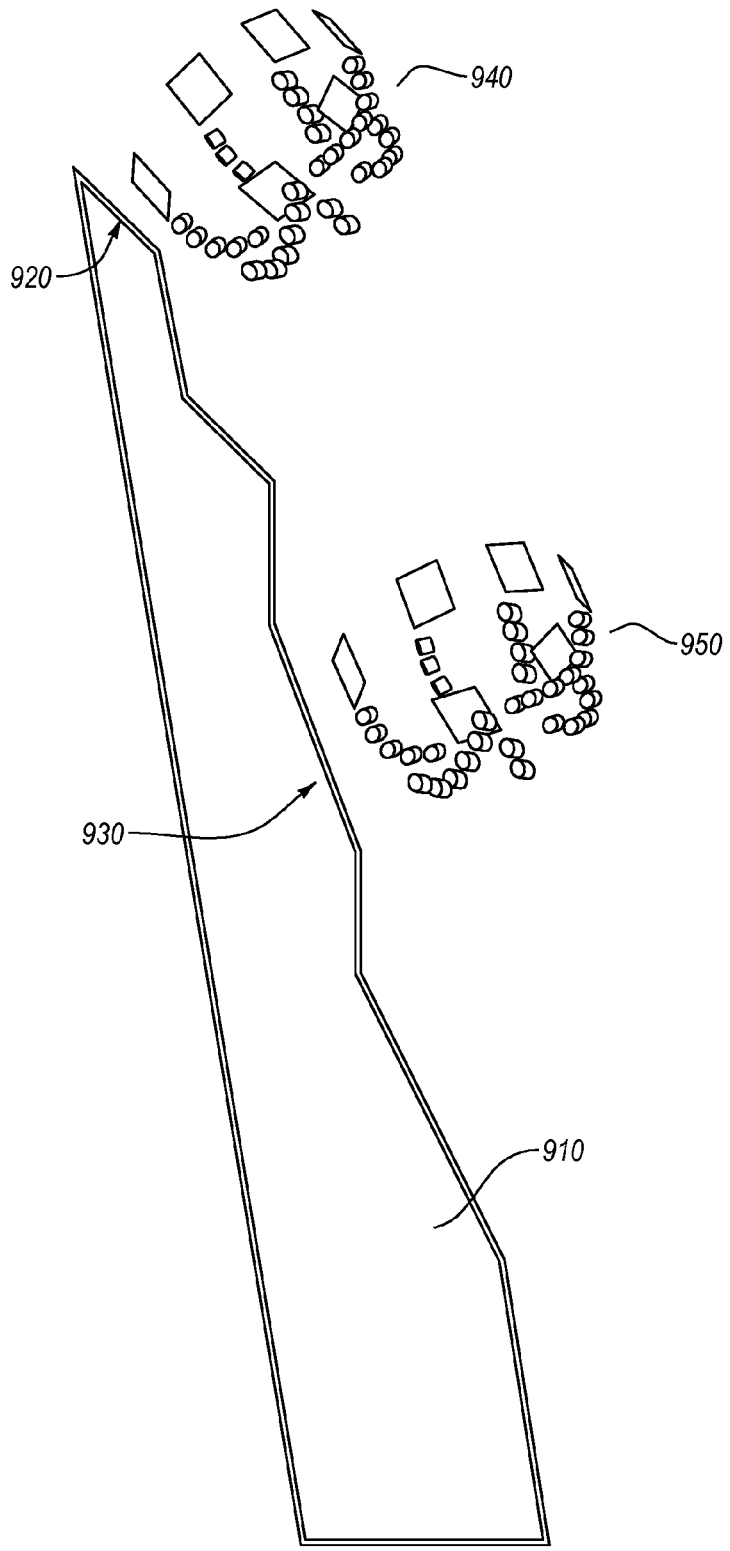
FIGS. 9 and 10 show example animation interfaces for use in a system for simulating downhole milling operations, in accordance with one or more embodiments of the present disclosure.

In FIG. 9, an output is rendered in one or more interface of the GUI 312 (FIG. 3) in the form of an animation. This animation reflects two instances in time as a milling bit (as shown, the cutting elements and/or gauge pads of a bit may be displayed) progresses down a wellbore against a whip having multiple ramp sections (e.g., a first whip section having a first slope at 920 and at least a second whip section having a second slope at 930). This can be useful for comparing how a defined mill bit and/or BHA will operate at different positions along a milling path during a milling procedure (in this case, wellbore departure). Performance data corresponding to the simulation can also be output in a same or different interface to complement the visual illustration/animation. This performance data can include results generated from running a simulation of the milling procedure(s). For instance, the performance data can include milling performance parameters. In the same or other embodiments, the performance data can include selected and/or modified milling operating parameters or simulation parameters to be used in running a simulation. For instance, performance data output from a simulation may be used as input for another simulation. In some embodiments, the performance data may include comparisons of milling performance parameters obtained through a simulation to desirable outcomes specified in the milling operating or other simulation parameters.

In another embodiment the visualizations of the mill bit(s) correspond to two different mill bits 940 and 950 having different corresponding milling tool parameters. This illustration or animation can be useful for comparing two mill bits and/or BHAs at the same or different locations in the milling path. In one embodiment, for instance, the visualization in FIG. 9 may show that the bit 950 has progressed further than bit 940 after the same amount of time has elapsed.

The simulation for each milling operation is controlled and defined by the whipstock parameters, the milling tool parameters, and the wellbore casing parameters, as well as the simulation parameters discussed herein. The visualization of the simulation can be rendered as an animation, with the milling bits 940 and 950 moving continuously along their path(s). In some embodiments, the visualization(s) can be static images.

Figure 10:
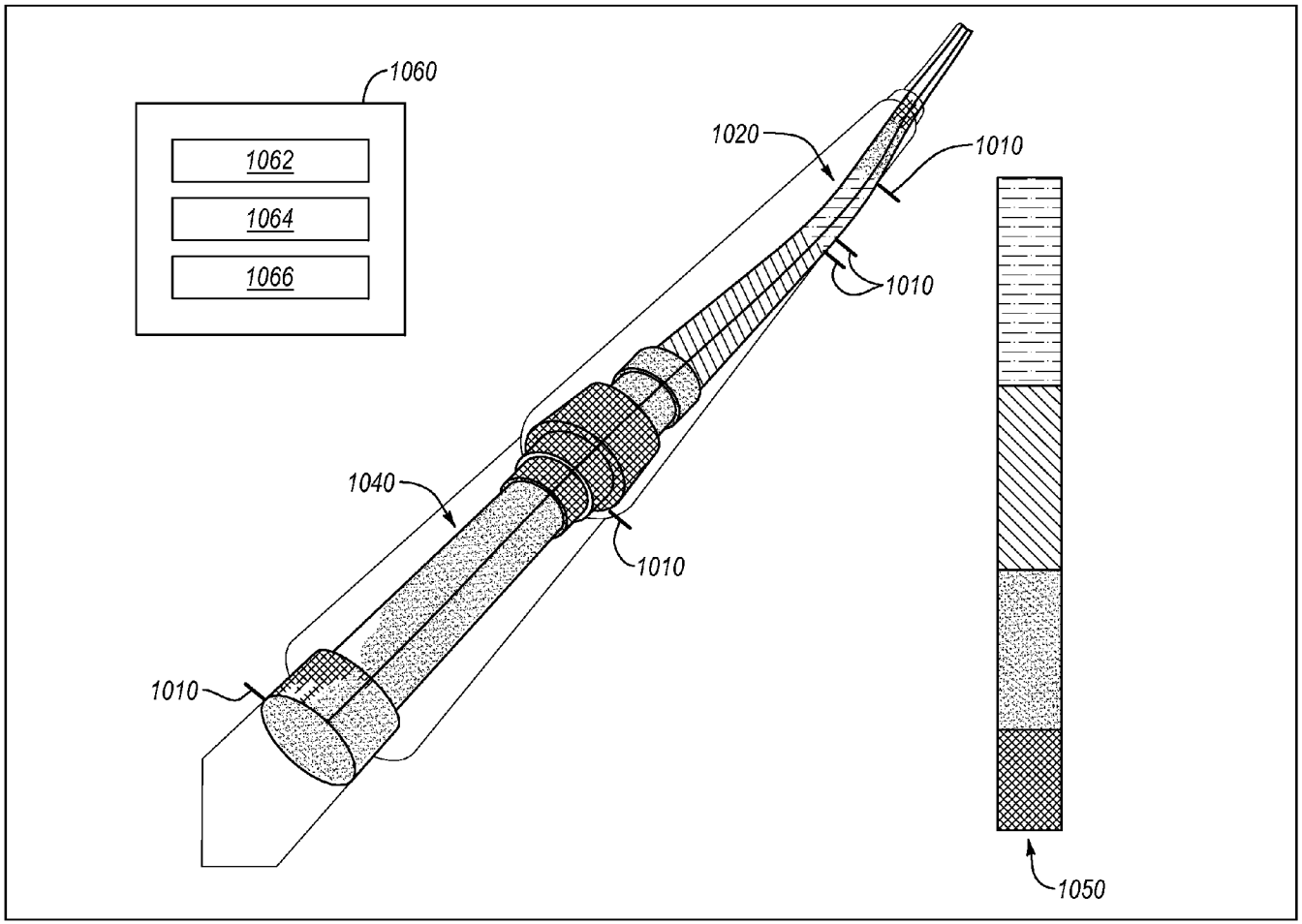

FIG. 10 illustrates a visualization of another simulation defined by the parameters selected by a user. In this simulation, the contact forces and bending moment of a milling BHA 1040 are visually illustrated/animated with elements 1010 and contour 1020, respectively. A color/pattern scheme defined by legend 1050 may be applied to the BHA 1040 to reflect corresponding forces that are defined by the legend. For instance, each color may be associated with a different force level. As the simulation is performed, the forces at different locations on the BHA 1040 can be identified, and the BHA 1040 can be color-coded based on the forces at each different location. Using the legend 1050, a user may then easily view the conditions at different portions of the BHA 1040 at a particular moment in time, or progressively as an animation or other visualization progresses through a milling operation.

In some embodiments, a simulation can also include simulation parameters that are displayed and that are selectably modifiable to control the simulation accordingly. For instance, window 1060 may include interactive elements 1062, 1064, and 1066 which, when selected and have input received therein, are operable to control the RPM, WOB, load, or other simulation parameters of the BHA 1040. When any of these parameters is changed, the GUI 312 (FIG. 3) may modify the simulation and corresponding visual output accordingly, based on an interaction of the milling tool parameters and the wellbore casing and/or whipstock parameters that are defined for the particular simulation. This can be useful for enabling a user to instantaneously visualize an impact of a parameter change to a particular milling operation, or a particular portion of a milling operation.

Returning briefly to FIG. 3, once the user inputs or otherwise customizes one or more milling components and other simulation parameters with the GUI 312, the computing device 302 may execute instructions using the computing processor(s) 306 in order to perform a simulation based on the customized milling component(s) and the corresponding component parameters selected or input by the user.

The milling simulation may be performed by the simulation engine 312-3 of the GUI 312 using one or more of the methods set forth herein. In one or more embodiments, the BHA may be modeled with beam elements (using finite element analysis (FEA) techniques as known in the art). Briefly, FEA may involve dividing a body under study into a finite number of pieces (subdomains) called elements. Particular assumptions may then be made on the variation of the unknown dependent variable(s) across each element using so-called interpolation or approximation functions. This approximated variation may be quantified in terms of solution values at special element locations called nodes.

Through this discretization process, the FEA method can set up an algebraic system of equations for unknown nodal values which approximate the continuous solution. Element size, shape, and approximating scheme can be varied to suit the problem, and the method can therefore accurately simulate solutions to problems of complex geometry and loading.

Each beam element may have two nodes. For a MWD/LWD tool, for example, the tool may be divided into beam elements, based on the geometry of the tool and sensor locations. The nodes may be located at the division points of the elements. During the simulation, a window may be milled in a casing and the milling bit may propagate as the bit progresses. Some or all portions of the BHA may be confined within the wellbore while the window is milled. The BHA may move dynamically during the simulation, depending on the loading and contacting conditions as well as initial conditions.

When the BHA moves in the wellbore, the nodes will have history of accelerations, velocity, displacement, etc. The location of the nodes with reference to the well center or wellbore can be determined. Representative results that are produced by the simulation may include: accelerations at the bit, mill, stabilizers, and other locations; velocities at the bit, mill, stabilizers, and other locations; displacements at the bit, mill, stabilizers, and other locations; the trajectory of the bit, mill, stabilizers, and other locations; torque of the bit, mill, stabilizers, and other locations; and contact forces at the bit, mill, stabilizers, and other locations. Any or all of these results may be produced in the form of a time history, box and whisker plot, 2D or 3D animation, picture, other representation, or some combination of the foregoing, including the examples illustrated in the figures.

Executing the simulation may generate a set of performance data (e.g., milling performance parameters). In some cases, the set of performance data generated may depend on the data selected or input by the user and/or data stored in one or more files (e.g., rock or material files based on physical tests or cutting elements scraping corresponding materials). User input may include instructions to generate specific performance data, such as, but not limited to, surface torque, WOB, bit RPM, cutter forces, build up rate, DLS, bending moment, von Mises stress, window quality, whip profile, walk rate, contact forces, other data, or some combination of the foregoing. Additionally, the performance data may include bit geometry, ROP, or hole size, among other things. The set of performance data may be stored in persistent storage (e.g., on storage device(s) 308) in some embodiments.

After and/or during a simulation, the set of performance data may be visualized through the GUI 312 (e.g., on the output device(s) 316). In some embodiments, visual outputs of the GUI 312 may include tabular data of one or more performance parameters. In the same or other embodiments, the outputs may be in the form of graphs and may be represented as ratios or percentages. A graphical visualization of one or more of the bit, blades, cutters, BHA components, or other components may be output. In some embodiments, a graphical visualization (e.g., a 2-D, 3-D, or 4-D graph or plot) may include a color scheme. For instance, a color scheme may represent different components, different levels of forces (e.g., vibrations) or stresses, fatigue, wear rates, or the like.

Some specific, non-limiting examples of visualizing performance data are shown in, and described with respect to, FIGS. 11-18.

Figure 11:
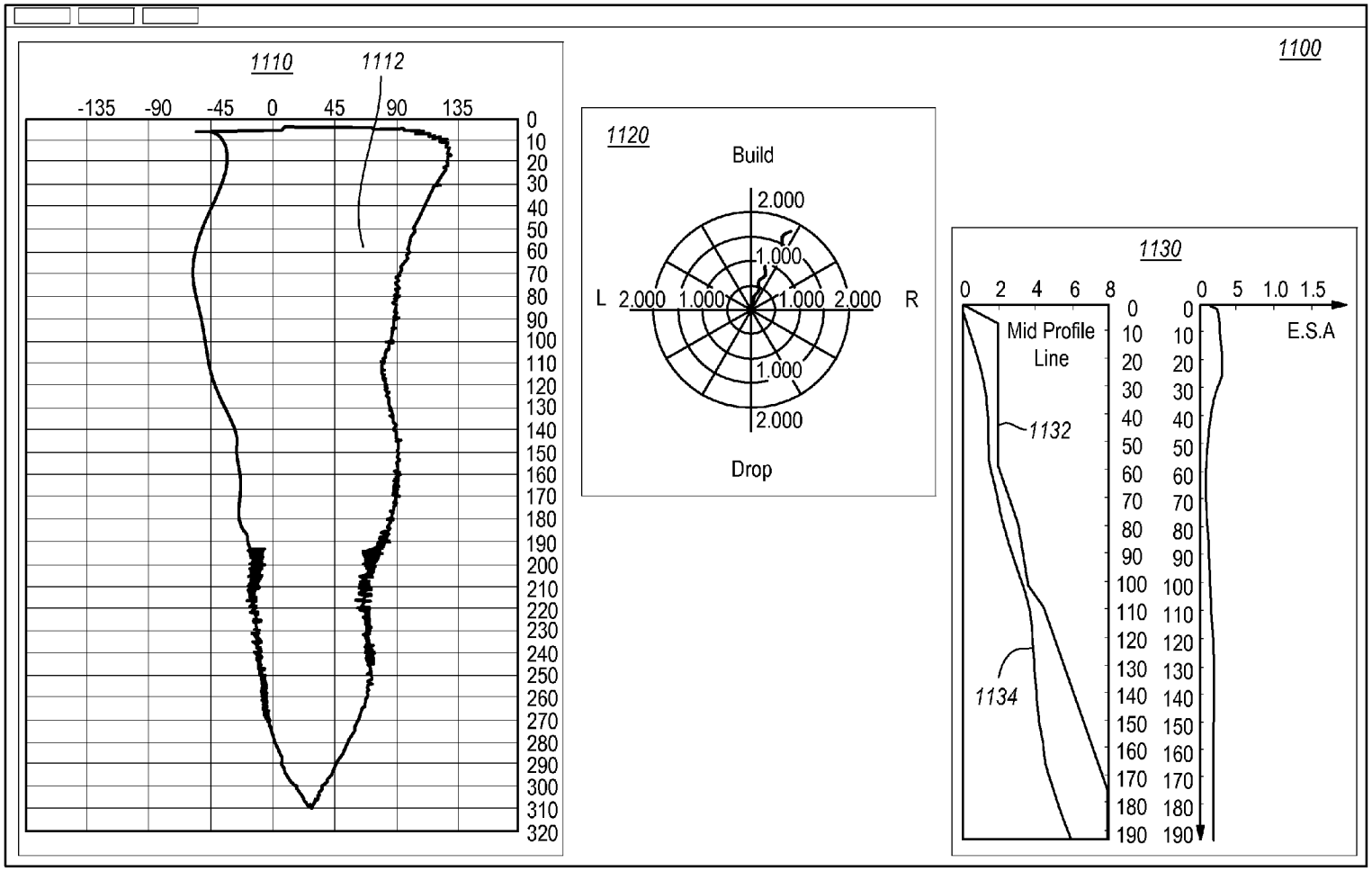
FIGS. 11-18 show example simulation output interfaces and performance data for BHA configurations corresponding to one or more simulated downhole milling procedures, in accordance with one or more embodiments of the present disclosure.

FIG. 11 illustrates an interface 1100 having a first frame 1110 that includes milling performance parameters rendered as a plot defining a casing window 1112. The plot in frame 1110 shows various features of the casing window 1112. For instance, the shape and dimensions (e.g., length, width, etc.) of the casing window 1112 are shown. In some embodiments, the volume of material removed from the casing window 1112 may be shown or otherwise provided.

Frame 1120 of the interface 1100 may show a related plot illustrating a bit position as a function of azimuthal angle of the wellbore. As shown, the bit may have had a tendency to move or "walk" to the right while milling along the whip surface. As shown, the casing window 1112 may not be centered (i.e., the casing window 1112 created by milling is off center due to the bit's tendency to move to the right during the simulation). Should the bit have shown little to no lateral movement during the simulation, the casing window 1112 shown in frame 1110 could correspondingly be graphed as a centered casing window.

In some embodiments, the interface 1110 may provide still other information. For instance, as illustrated by a plot in frame 1130, the resulting or deformed shape of the whipstock may be shown. In particular, in this embodiment, the frame 1130 may plot or otherwise visualize the original whip profile 1132. The whip profile after milling 1134 may also be plotted or otherwise visualized. In the illustrated embodiment, the profiles 1132, 1134 may be depicted as an area (length vs. width) showing the amount of whip material removed during the milling simulation, and the corresponding resultant shape of the whip. An indication of the volume of material removed from the whip (e.g., a total value or a unit per length) may also be provided in frame 1130.

Figure 12:
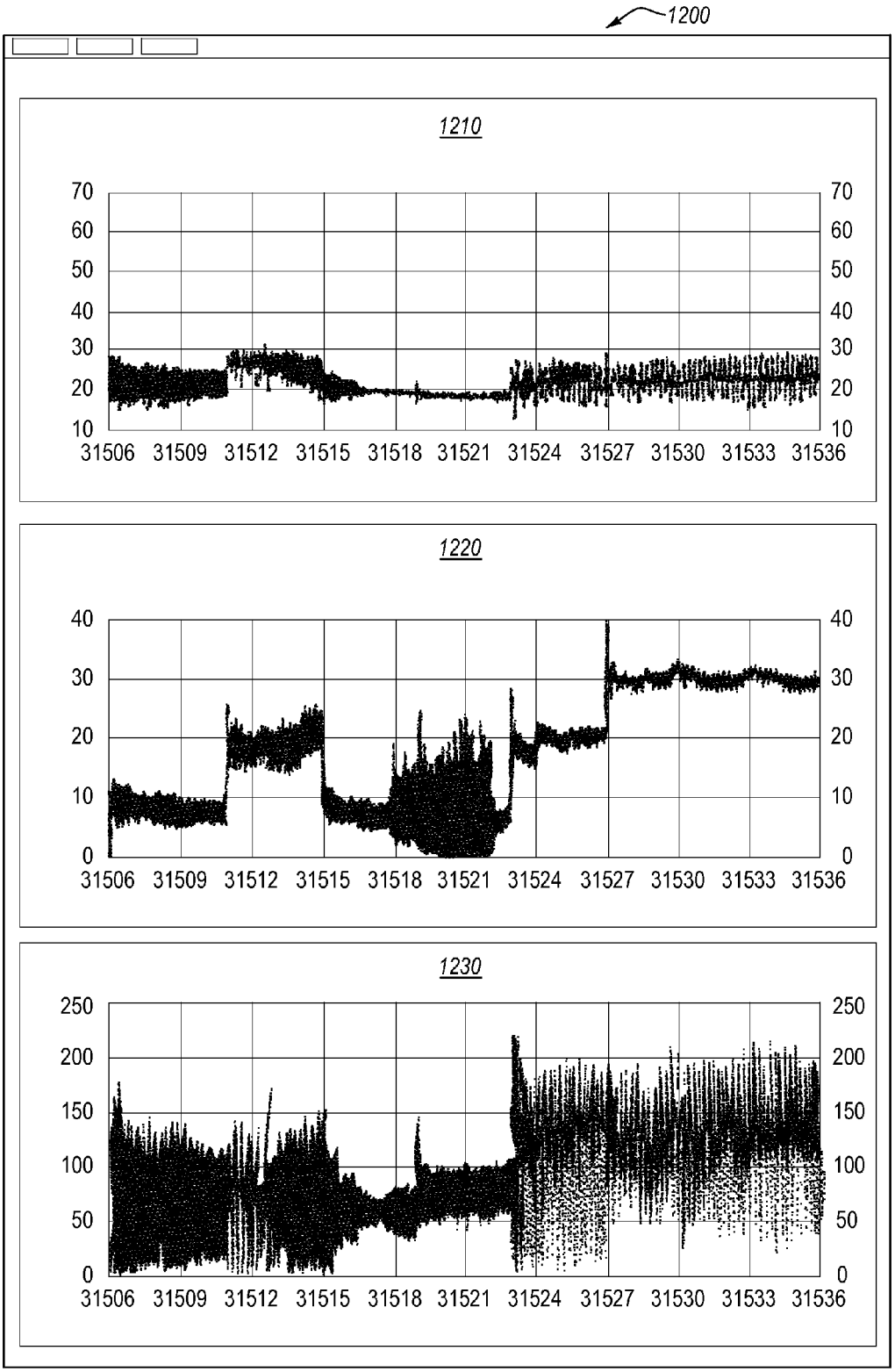

FIG. 12, on the other hand includes an interface 1200 that illustrates performance data (e.g., milling performance parameters) for a BHA in 2D graphs, including a surface torque graph 1210, a surface WOB graph 1220, and a bit RPM graph 1230, corresponding to a set of defined milling component parameters. More particularly, the surface torque graph 1210 is shown as illustrating the surface torque (e.g., in klbf-ft) for different bit depths (e.g., measured in feet). As shown in this particular embodiment, for instance, the surface torque over the illustrated bit depth range may vary from 4 klbf-ft at a bit depth of 31,523 ft. (9,608 m) to a maximum surface torque of 31 klbf-ft at a bit depth of 31,513 ft. (9,605 m).

For the surface WOB graph 1220, the surface WOB (e.g., in klbf) may be shown for different bit depths (e.g., measured in feet). In this embodiment, the surface WOB may vary from a minimum of 0 klbf at a bit depth of 31,520 ft. (9,607 m) to a maximum surface WOB of 40 klbf at a bit depth of 31,527 ft. (9,609 m) from the surface. The bit RPM graph 1230 may similarly show the RPM (e.g., in rotations per minute) of the bit at different bit depths. As shown in this plot, the bit RPM may rapidly fluctuate (e.g., at bit depths between 31,524 ft. (9,609 m) and 31,536 ft. (9,612 m). More particularly, in this plot, the bit is shown as having an RPM which may vary from 0 RPM at a bit depth of 31,512 ft. (9,605 m) to 220 RPM at a bit depth of 31,523 ft. (9,608 m).

The performance data in FIG. 12 is directed to a single BHA, and includes a single set of graphs for different milling performance parameters of that BHA during a single simulation. In other embodiments, however, the visualized performance data may be varied. For instance, one or more comparative set(s) of graphs can be provided for one or more differently configured BHA(s) performing the same milling operation, for the same BHA performing different milling operations, or for different BHAs performing different milling operations. Further, in some embodiments, different performance data may be provided in a graphical, tabular, or other manner. By way of illustration, downhole torque or vibration data (e.g., lateral, vibrational, or torsional vibrations) may be shown.

Figure 13:
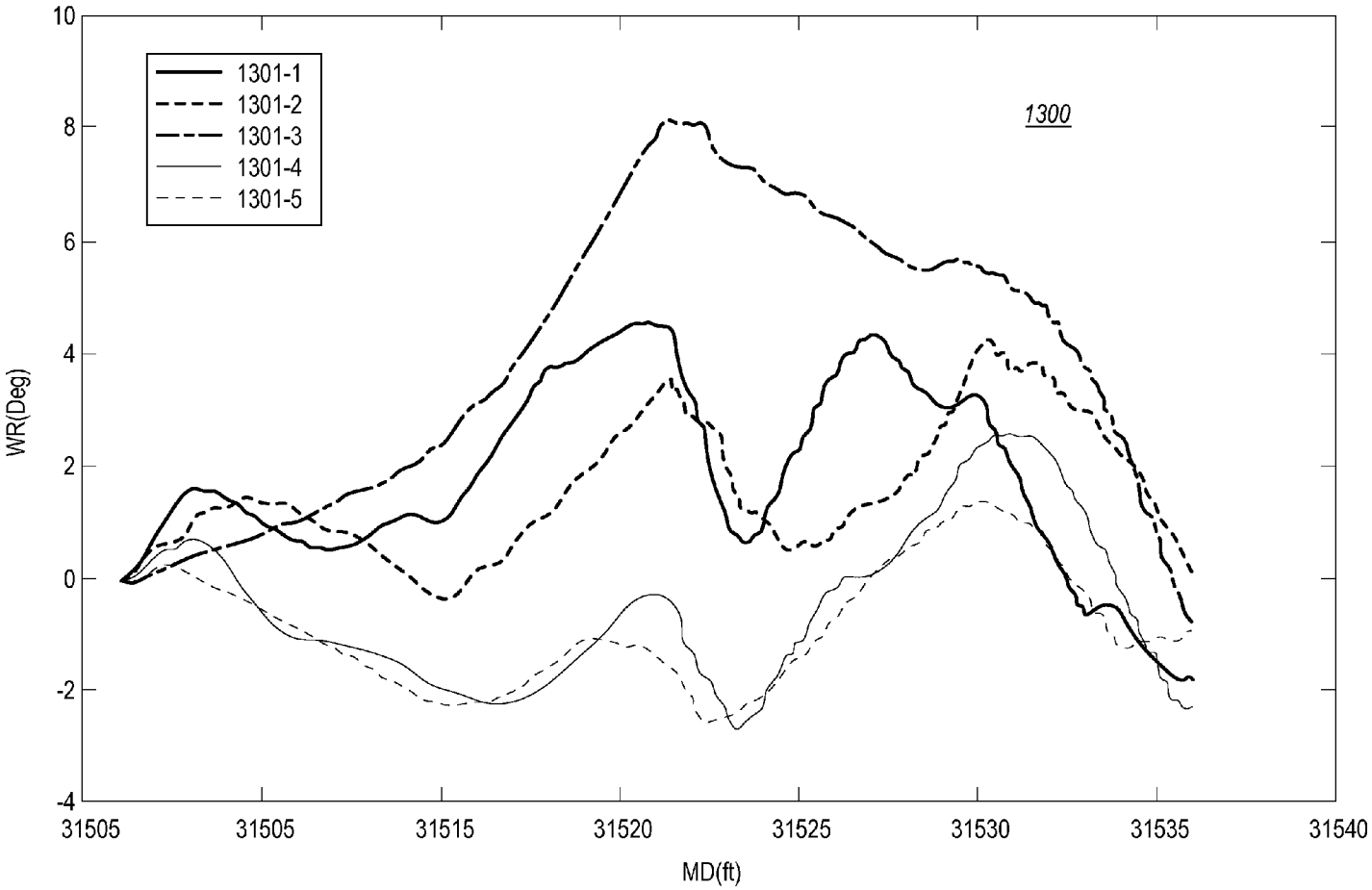

FIG. 13 illustrates another form of simulation output and performance data that may be presented as output in some embodiments of the present disclosure. In particular, in this embodiment, the output may be in the form of a plot showing the tendency of various different BHAs to walk during a pre-defined and simulated milling procedures. In this particular example, a field-run BHA run in a wellbore departure procedure over a multi-ramp whip (1301-1) is compared to four different BHAs (1301-2 to 1301-4), and the results show some BHAs have more of a tendency to walk slightly to the left (below the zero line), whereas other BHAs may walk slightly to the right (above the zero line). For this particular embodiment, the BHAs that were tested include: a surface rotated BHA deflected by a multi-ramp whip (1301-2), and the same BHA as deflected by a single-ramp whip (1301-3). A motor-driven BHA is also shown in use with a multi-ramp whip (1301-4), and the same motor-driven BHA is shown when used with a single-ramp whip (1301-5). As shown in this embodiment, the field-run BHA 1301-1 most closely followed the simulated results for the surface rotated BHA 1302. Also, the surface-rotated BHAs had a tendency to walk to the right while the motor-driven BHAs had a tendency to walk to the left.

Figure 14:
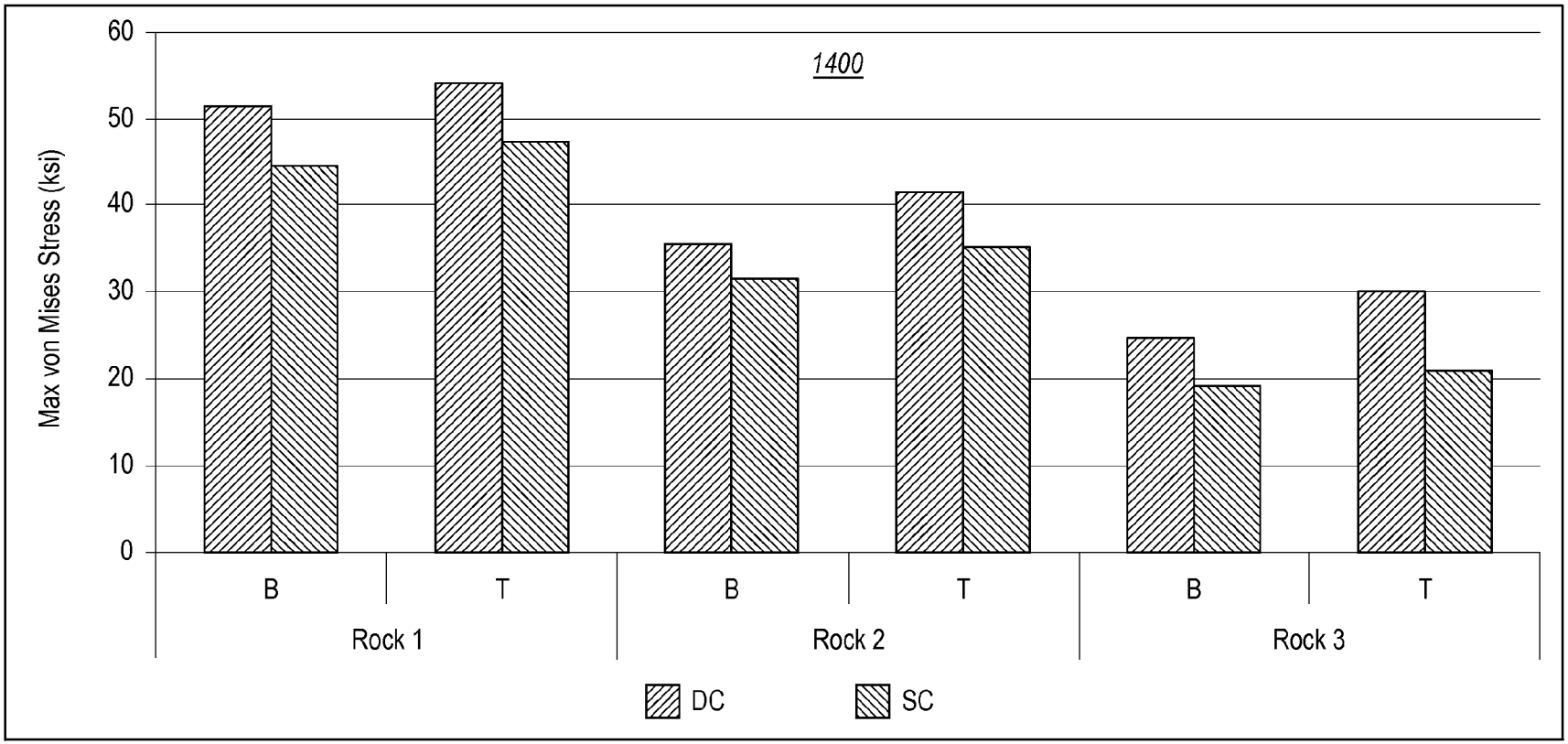

FIG. 14 illustrates yet another form of simulation output and performance data that may be presented as output in the form of a graph 1400. In this graph 1400, a summary of maximum von Mises stresses for two different BHAs (B and T), and several rock types (Rock 1, Rock 2, and Rock 3) are shown. In some embodiments, the B BHA may be a bi-mill BHA, and the T BHA may be a tri-mill BHA. Results of single casing (SC) and dual casing (DC) milling scenarios are also represented. In this particular embodiment, Rock 1 had a rock strength of 2-5 ksi, Rock 2 had a rock strength of 5-10 ksi, and Rock 3 had a rock strength of 20-30 ksi. As shown, stress on a tri-mill may generally be expected to be higher than on a bi-mill. Similarly, higher stresses are generally expected for dual casing milling procedures relative to single casing milling procedures. In this embodiment, for higher rock strength, lower stress may be expected.

Figure 15:
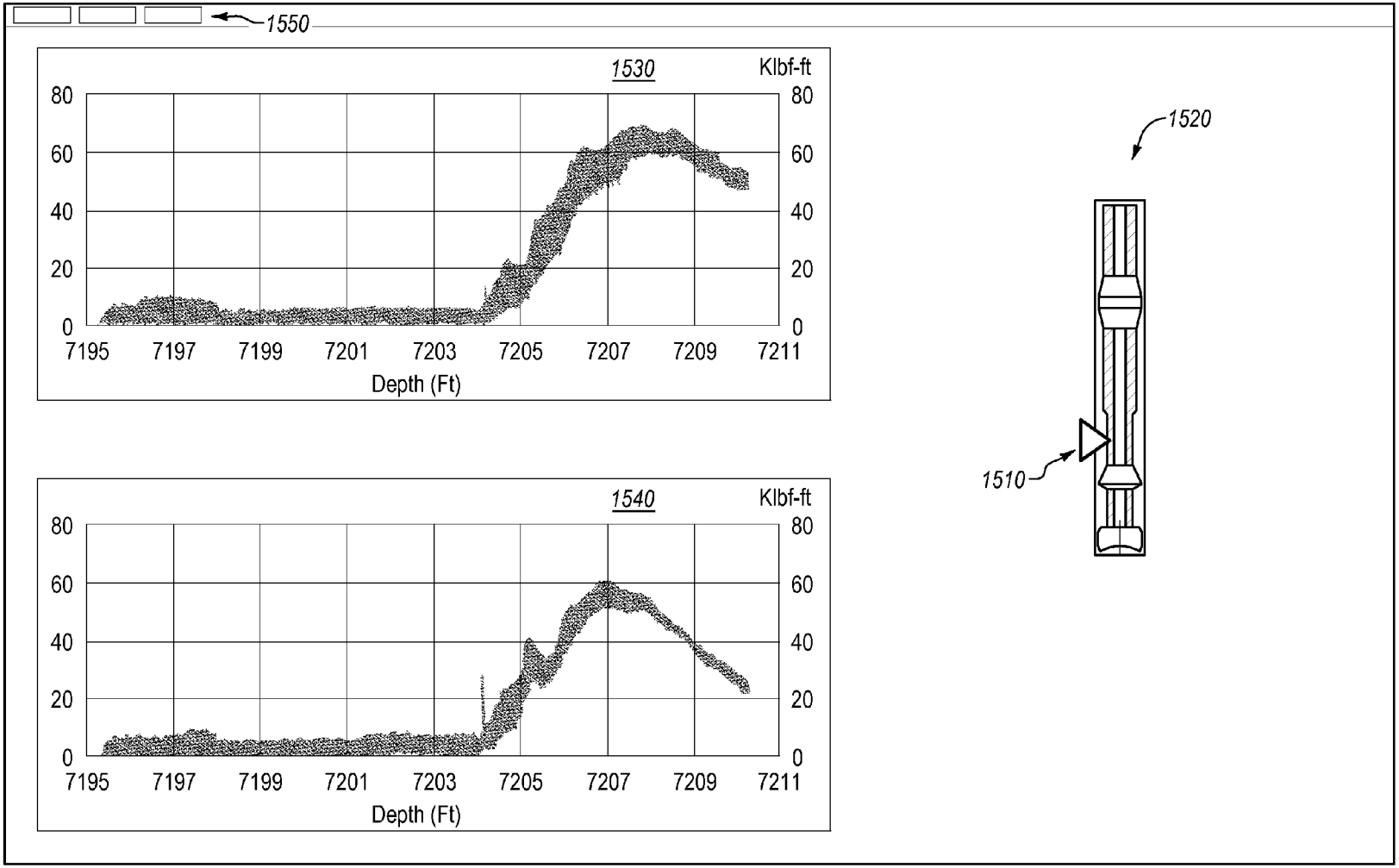

FIG. 15 illustrates another embodiment of an interface 1500 for controllably displaying simulation output. In this embodiment, the simulation output includes performance data that reflects internal forces for a particular node 1510 of a virtual BHA 1520 (e.g., a tri-mill BHA) that was selected, designed, modified, or otherwise defined or accessed according to the techniques described herein (e.g., with any of the interfaces described herein or other interfaces that are provided by the GUI 312). The performance data is displayed in two historical plots. The first historical plot 1530 shows internal stresses occurring at the node 1510 during a simulation of a milling process in which the virtual BHA 1520 mills through a virtual dual casing wellbore. Historical plot 1540, on the other hand, reflects the internal stresses occurring at the node 1510 when performing a similar simulation of the virtual BHA 1520 milling through a single casing wellbore.

In some embodiments, the user can selectably interact with the node 1510, by selecting and moving the node 1510 to another location along the virtual BHA 1520 to thereby cause the computing system to render different output corresponding to a node at the other location. In the same or other embodiments, the user can select and the computing system can receive a plurality of different nodes/locations on the virtual BHA 1520 to cause the computing system to dynamically generate/render a plurality of corresponding outputs for the selected nodes.

The user can also utilize the interface objects to select different types of simulation outputs to render, as well as different simulation scenarios to graph in the simulation output. When the interface objects 1550 are selected, the interface 1500 displays different selectable options for modifying the simulation scenarios, graphing options (e.g., types of graphs, performance metrics/data to graph, etc.), node selection options, BHA component selection options, and so forth.

Figure 16:
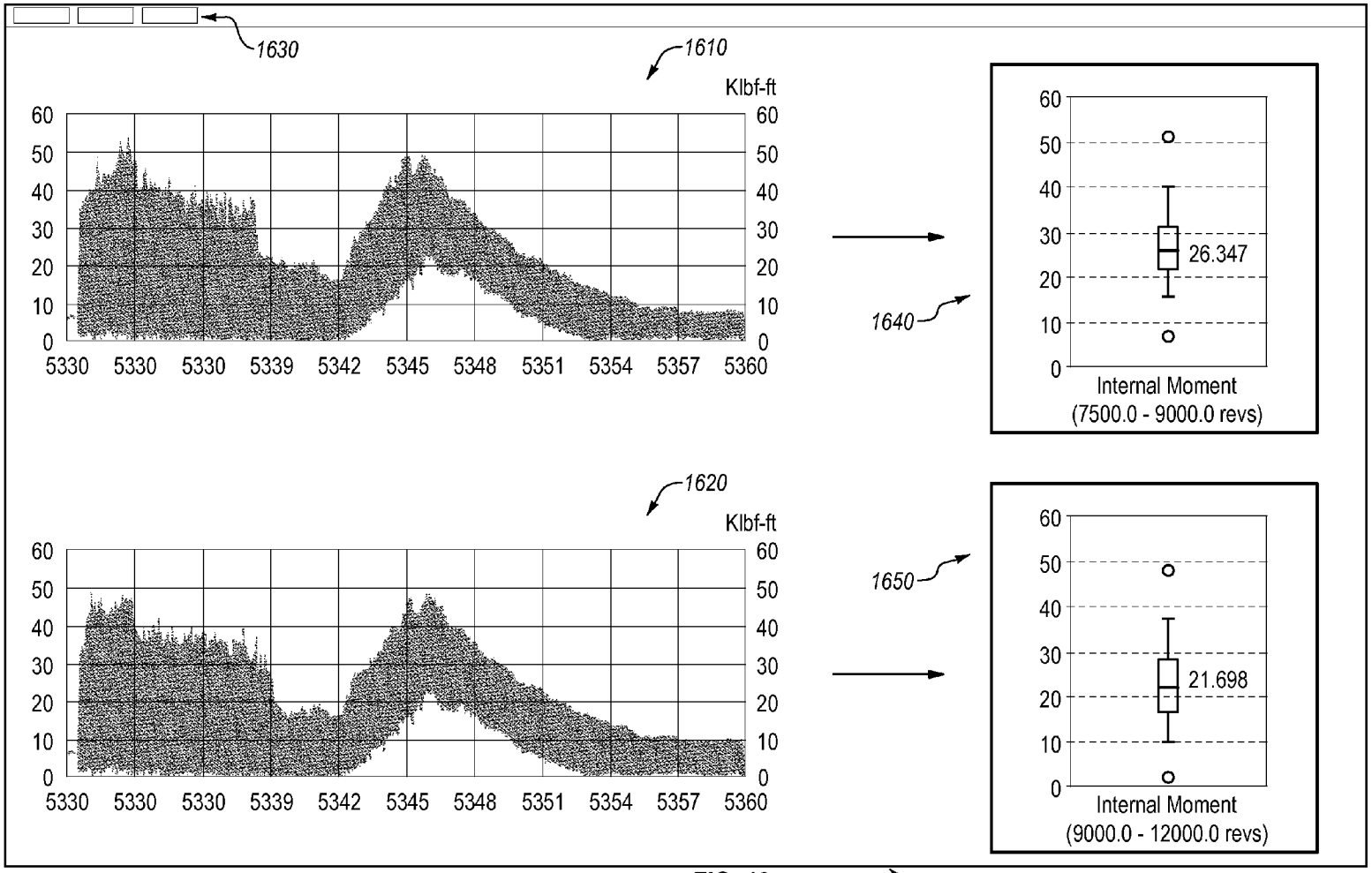

FIG. 16 illustrates yet another embodiment of an interface 1600 for controllably displaying simulation output. In this embodiment, historical plots 1610 and 1620 of internal forces are graphed for a particular node of a virtual milling tool or component (not shown) that were calculated to occur during simulated milling procedures involving cemented casing(s) (plot 1610) and non-cemented casing(s) (plot 1620). While the corresponding BHA components and selected node are not currently displayed in the interface 1600, they can be selectably displayed and/or modified by selecting interactive objects 1630, as described herein.

The interactive objects 1630 can also be used to select the display of additional images and graphs, such as the uncertainty plots 1640 and 1650, which visually indicate that cement behind a casing could, in some embodiments, affect the corresponding bending moment (e.g., reduce the bending moment by up to 20+%).

Figure 17:
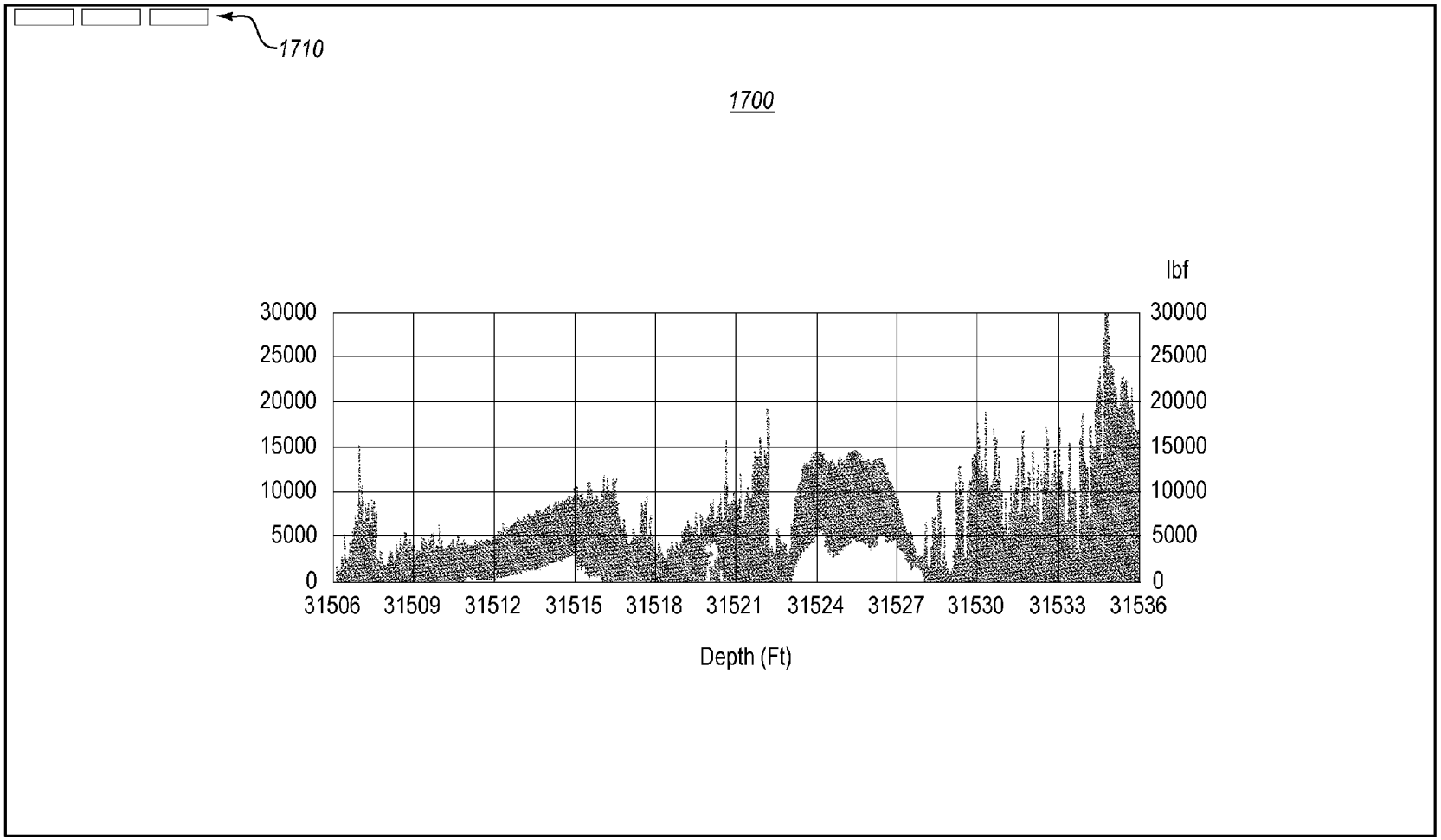

In the embodiment of FIG. 17, one or more interactive objects 1710 of the interface 1700 may be used to select a graph or other chart (or multiple graphs/charts) of performance data, including a historical plot of contact forces at a selected node, measured based on depth, during a particular simulated milling procedure. As discussed herein, the node and simulation parameters, as well as the graphing options, are selectably controllable (e.g., through menu options) in response to selecting the interactive objects 1710.

Figure 18:
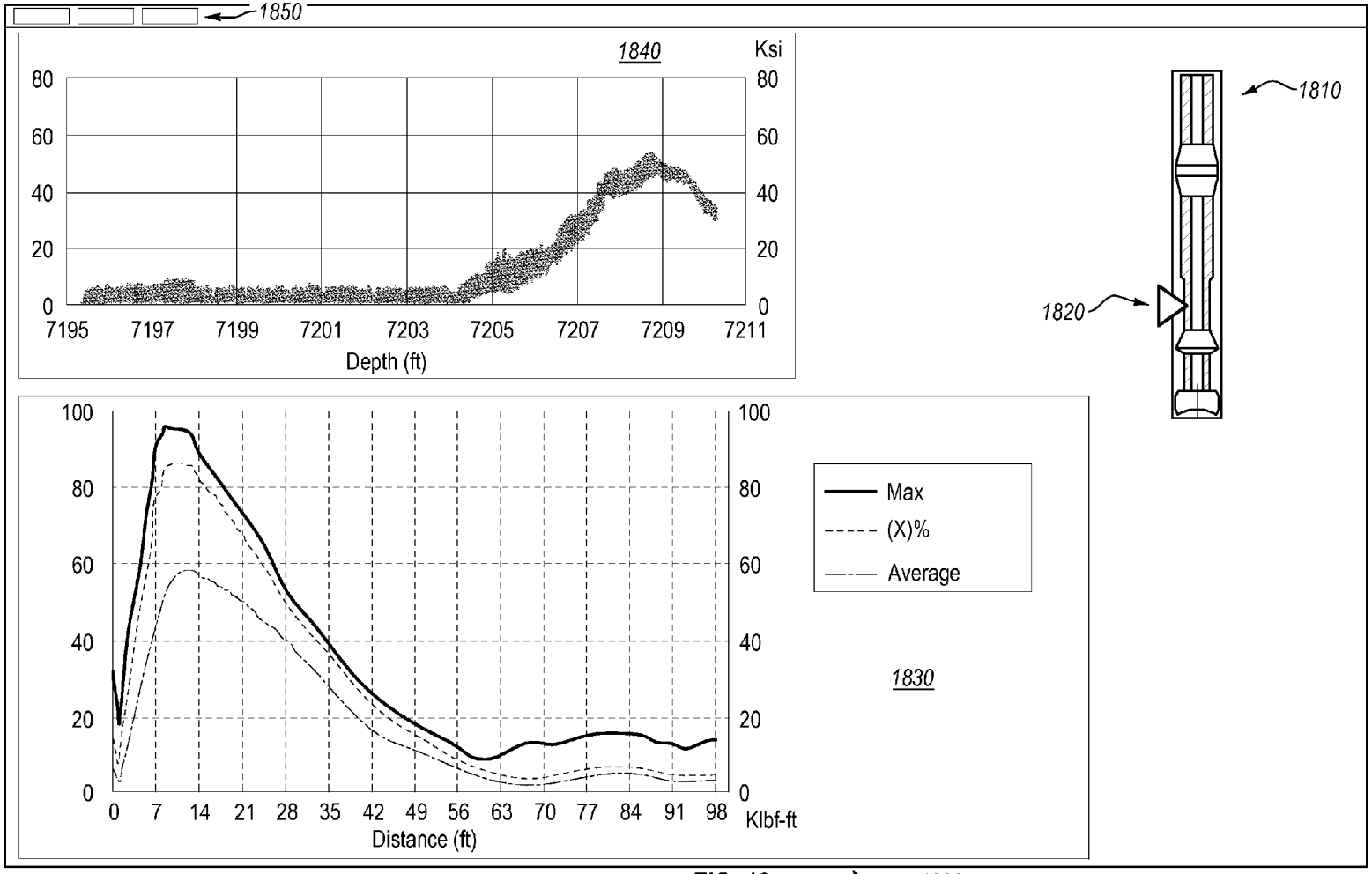

FIG. 18 illustrates another example of how performance data can be rendered by the interfaces of the GUI 312 (FIG. 3) for simulated milling procedures. In this embodiment, an interface 1800 displays a virtual BHA 1810 and a node selection object 1820, which may be positioned at a user-specified location on the virtual BHA 1810. The interface 1800 may include at least a first graph 1830. The first graph 1830 may, for instance, represent bending moments for a virtual milling tool assembly (e.g., virtual BHA 1810) relative to a distance. The distance may be based on distance from surface, distance from a particular component of the virtual BHA 1810, or the like. In FIG. 18, the distance may be of a variable node from a lead mill on the virtual BHA 1810. The graphed bending moments may include maximum bending moments, average bending moments, bending moments that are a selected percentage of the bending moments (or maximum or average bending moments) occurring at the variable distances. The various output parameters may each be selectable through interactive objects 1850 of the interface 1800, as generally described herein with regard to other interface embodiments.

The bending moments may also be plotted as a function of milling depth in another plot 1840. This plot 1840 specifically shows bending moments occurring over time for a selected simulation at a particular node defined by the node selection object 1820. Any of the plot parameters used to control or affect the rendering of the performance data for plots 1830 and 1840 can be modified through selectable options that may be presented to a user in response to a user selection of the interactive objects 1850.

In some embodiments, once a simulation is run and the user is presented with a set of performance data and/or the simulation visualizations, the user may modify at least one parameter associated with the simulation (e.g., any milling tool parameter, whip parameter, casing parameter, or operating parameter), such as, for example, a whip profile or a quantity, position, or size of nested casings. Modification may involve selecting a parameter from pre-existing values or inputting the parameter with any of the interfaces of the GUI 312 (FIG. 3) to obtain a modified BHA, a modified wellbore, a modified milling operation, or some combination of the foregoing.

After modification of the BHA, the wellbore, the whipstock, the wellbore casing, or the milling operation parameters, a second simulation may be executed (e.g., by the computing system 300 of FIG. 3). The second simulation may include use of the modified simulation parameter and may generate a second set of performance data.

Similar to the first simulation, the second simulation may include instructions to generate specific performance data, such as, but not limited to, surface torque, WOB, bit RPM, cutter forces, build-up rate, DLS, bending moment, von Mises stress, window quality, resulting whip profile, walk rate, contact forces, vibrational data, other data, or some combination of the foregoing. Additionally, the performance data may include resulting bit geometry (e.g., after wear of cutting elements), wear rate, ROP, hole size, or hole quality, among others. The set of performance data may be stored (e.g., persistently on storage device(s) 308).

The initial set of performance data and the second set of performance data may be presented using GUI 312 (FIG. 3) and an output device(s) 316 (FIG. 3). The sets of performance data may be presented to the user for comparison and may be presented separately or in combination. The sets of performance data may be presented or visualized using any tools known to a person having ordinary skill in the art in view of the disclosure herein, such as, for example, plots, graphs, charts, and logs. In some embodiments, differences between the sets of performance data may be presented in lieu of the sets of performance data themselves.

Further, similar to the first and second simulation requests, field data may be obtained from one or more sensors (e.g., an MWD or LWD, a downhole sensor, a surface sensor, etc.) to generate additional sets of performance data to compare to the first and/or second sets of performance data. Any of the foregoing performance data can then be used to selectably tune/calibrate the simulation system. With a calibrated simulation system, additional or other simulations may be run to otherwise improve a design of a milling BHA, a milling component, or a milling procedure. In some embodiments, sensors used to obtain field data may be located at one or more discrete locations on a BHA. In some embodiments, the obtained field data may be used to tune/calibrate a simulation system by comparing field data to simulated results for the corresponding, discrete locations on the BHA. The calibration may also increase reliability of simulated performance data at other locations within the BHA, and for which field data is not available.

The milling simulations described herein may be performed using one or more of the methods set forth below or as otherwise described herein.

Figure 19:
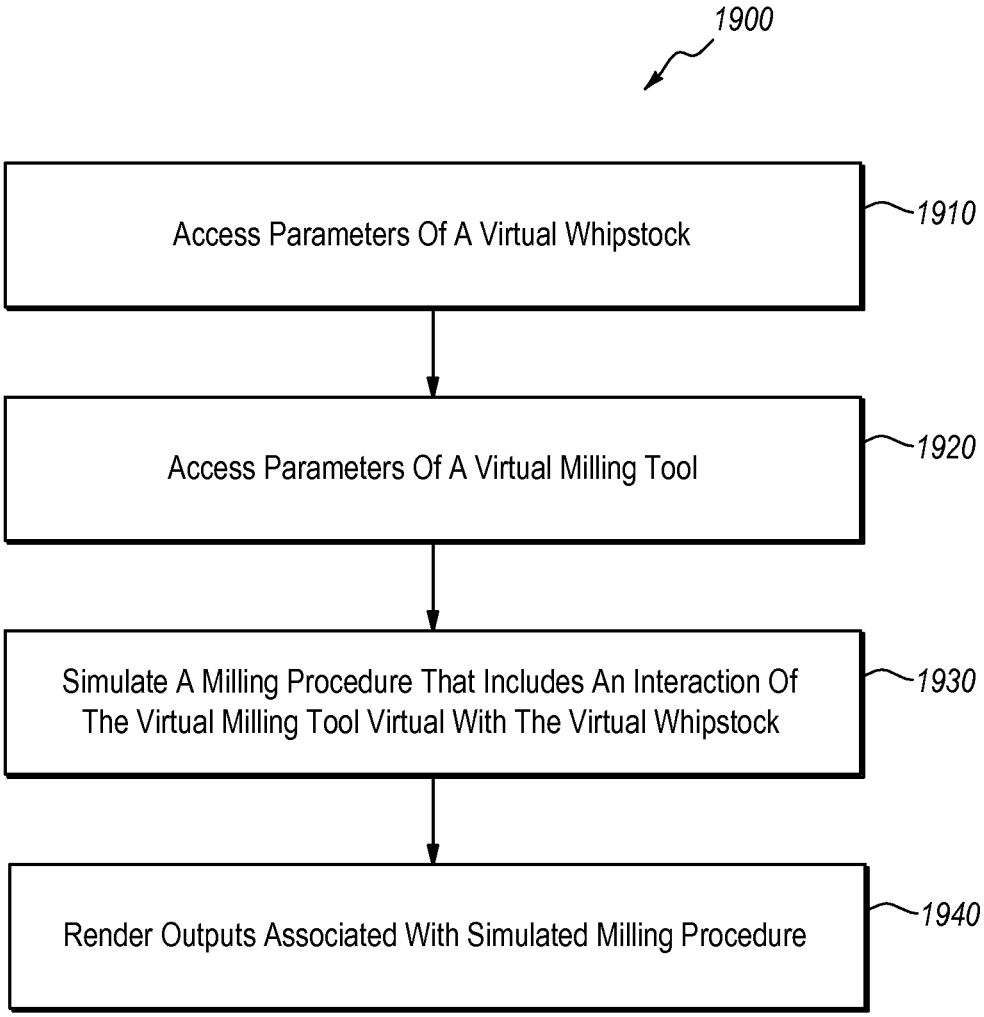
FIGS. 19-21 show flow diagrams corresponding to methods for simulating downhole milling procedures, in accordance with one or more embodiments of the present disclosure.
Figure 20:
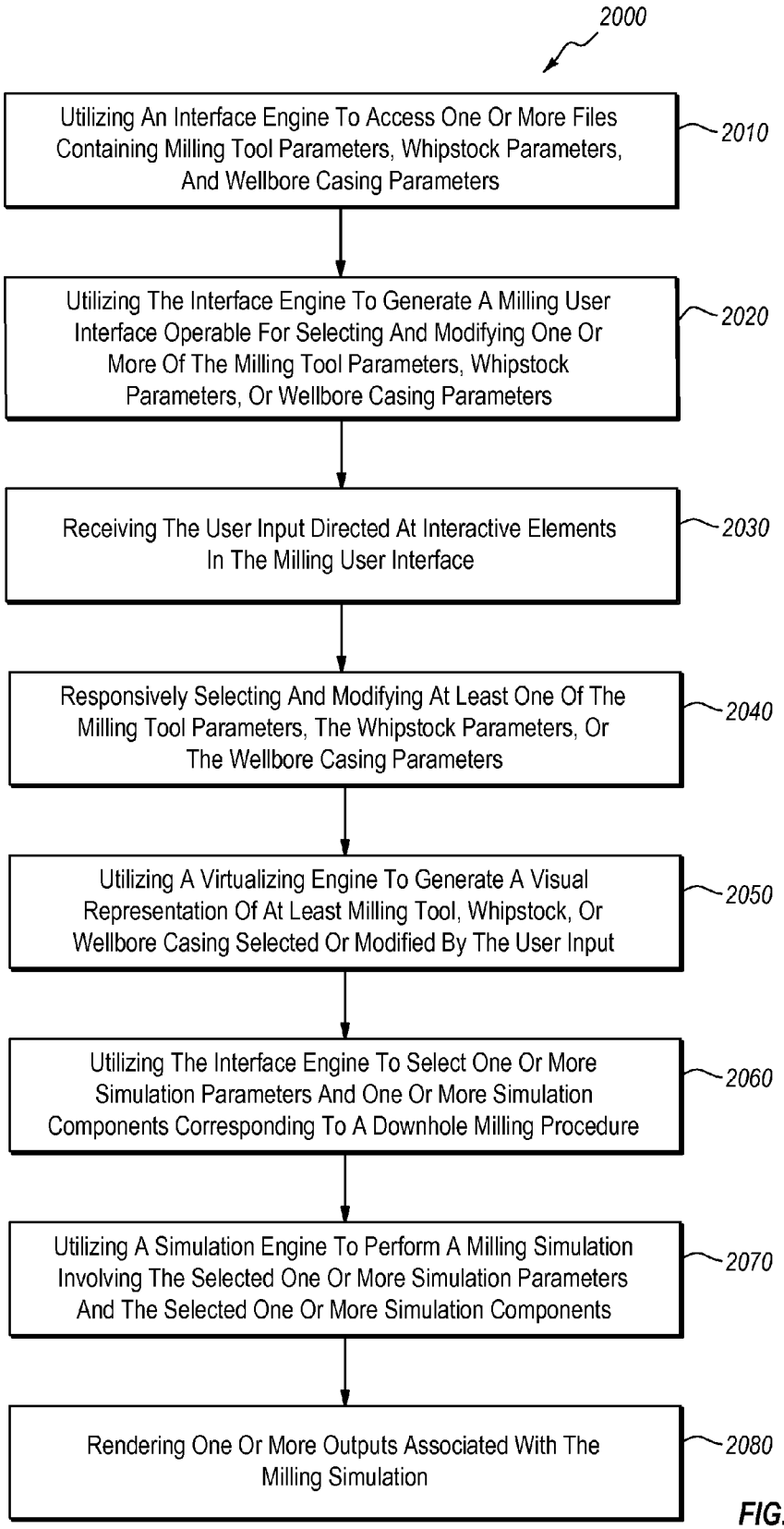
Figure 21:
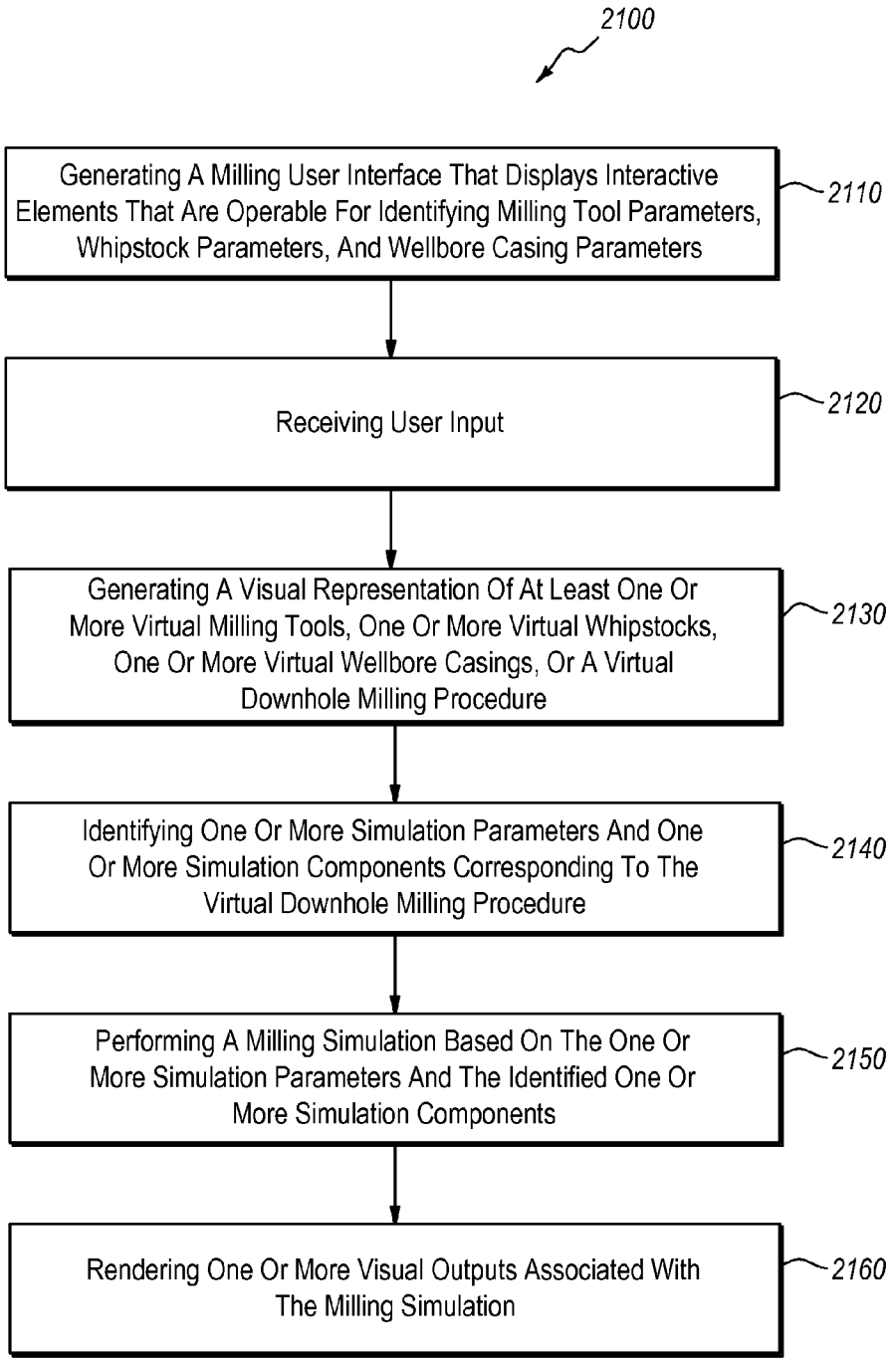

FIGS. 19-21 illustrate flow diagrams that include some of the acts that can be implemented for simulating milling procedures. It will be appreciated, however, that the illustrated acts can sometimes be performed in different sequences than shown. Likewise, other acts may be added and/or some acts may be removed. The scope of the present disclosure thus extends to methods including more or fewer than the particular acts that are presently illustrated in the flow diagrams of FIGS. 19-21.

FIG. 19 illustrates a flow diagram of one embodiment of a method 1900 for simulating a milling procedure. In the illustrated embodiment, the method may include accessing parameters of a virtual whipstock (act 1910). Accessing the parameters in act 1910 may be performed in various manners. For instance, the parameters 1910 may be accessed from a storage device (e.g., on a file), from user input, from a sensor, or from myriad other sources. Further, a virtual whipstock may be defined by various parameters, including parameters similar, or even identical to, a physical whipstock. The whipstock may be considered virtual, however, as the whipstock is used in a simulation, as opposed to use of a physical whipstock in a field run.

In some embodiments, the method 1900 may include accessing parameters of a virtual milling tool (act 1920). Accessing the virtual milling tool in act 1920 may also be performed in various manners, including through access of data on a storage device, from user input, from sensors, or the like. In some embodiments, the method 1900 may simulate a milling procedure by at least simulating an interaction of the virtual milling tool with the virtual whipstock (act 1930). It is noted that the simulation (act 1930) can include performing a finite element analysis of at least one of the virtual whipstock or the virtual milling tool, as also described. This can be done iteratively for different parameters and for different instances in time. The simulation can also include an analysis of one or more wellbore casing parameters.

As also discussed herein, the simulation (act 1930) may be performed by a computing system with a GUI and/or simulation engine. The simulation engine may, for instance, evaluate beams and nodes in a finite element analysis to simulate the interaction of the virtual milling tool and the virtual whipstock.

In some embodiments, simulating the milling procedure in act 1930 may be performed at a rate that is about equal to, or faster than the actual milling procedure being simulated. In some cases, however, the simulation engine may perform hundreds of thousands and potentially millions of calculations a minute, and simulating the milling procedure may occur at a rate slower than the actual milling procedure being simulated. The complexity of calculations can be illustrated by considering an example virtual milling tool with 100 cutting elements, rotating at speed of 150 RPM. Each cutting element may therefore interact with a casing or wellbore 150 times a minute (at least 15,000 interactions a minute for all cutting elements). Each interaction may include a shear force, an impact force, a normal force, and numerous other forces to be considered. The combination of these and forces and interactions may be used to determine von Mises stresses, bending moments, and the like at the cutting element level, as well as at the mill level. At the same time, fluid may flow within a wellbore, and the cutting elements and mill body may continuously be interacting with the fluids (the flow of which may vary based on the rotation and vibration of the bit, among other parameters). Further still, the fluid may carry cuttings/debris, which can also interact with the cutting elements and mill body. Additionally, the milling tool may include or be coupled to drill collars, drill pipe, additional mills, stabilizers, and other components, each of which have discrete components and surfaces that may interact with a casing or wellbore, fluid in the wellbore, debris, and the like. Each interaction of other components may affect the mill and the cutting elements on the mill.

In some embodiments, the method 1900 may further include rendering one or more visual outputs associated with the simulated milling procedure (act 1940). As noted herein, the parameters of the virtual whipstock and the virtual milling tool can be accessed from the storage device(s) of the computing system 300 (FIG. 3) or remote storage devices, or from selectable input. The simulating can be performed by the GUI 312 (FIG. 3), as can the rendering of the visual outputs, as described herein. As discussed herein, any number of different performance parameters may be rendered, displayed, or otherwise output in a simulation system as discussed herein.

After any number of simulations are run, a user can review the results of the simulations to identify and select any combination of BHA components that are determined to be optimal or preferred for a particular milling procedure. User selections can be made in response to user input entered at one or more interactive elements of the GUI 312 (FIG. 3). Selections can also, sometimes, be made automatically by the interfaces of the GUI 312, based on any predetermined criteria. A memorialization of the desired selection(s) can be made by saving a BHA file that is subsequently accessible by the GUI 312 to display the desired selection(s).

FIG. 20 illustrates another flow diagram of an embodiment of a method 2000 for causing a computing system, like computing system 300 of FIG. 3, having one or more processors 306, an interface engine 312-1, a visualization engine 312-2, and a simulation engine 312-3, to simulate a downhole milling procedure.

In this embodiment, the computing system 300 may utilize the interface engine 312-1 to access: (1) one or more files 316 containing milling tool parameters specifying characteristics of one or more virtual milling tools; (2) whipstock parameters specifying characteristics of one or more virtual whipstocks; and (3) wellbore casing parameters specifying characteristics of one or more virtual wellbore casings (act 2010). This may be accomplished, as described herein, through the GUI 312 interfaces.

A computing system (e.g., the computing system 300 of FIG. 3) may also utilize an interface engine to generate one or more milling user interfaces 312-4 that display interactive elements. The interactive elements may, in response to user input directed at the interactive elements, be operable for at least one of selecting or modifying one or more of the milling tool parameters, one or more of the whipstock parameters, or one or more of the wellbore casing parameters (act 2020). In some instances, this may be accomplished when the interface provides the parameters as interactive elements and/or with input fields, as described herein.

Thereafter, in response to receiving the user input 2030 directed at the interactive elements, the computing system may, in some embodiments, responsively select and/or modify at least one of the milling tool parameters, the whipstock parameters, or the wellbore casing parameters (act 2040).

A computing system may also utilize a virtualizing engine (e.g., the virtualizing engine 312-2 of FIG. 3) to generate a visual representation of at least one of the one or more virtual milling tools, the one or more virtual whipstocks, or the one or more virtual wellbore casings selected or modified by the user input through a GUI (act 2050).

The computing system may also utilize an interface engine (e.g., the interface engine 312-1 of FIG. 3) to select one or more simulation parameters and one or more simulation components corresponding to the downhole milling procedure. The selected one or more simulation components may include at least one of the one or more virtual milling tools, the one or more virtual whipstocks, or the one or more virtual wellbore casings (act 2060). In some embodiments, simulation components may be selected or modified by the user input. At least a portion of the method 2000 may be iterative. For instance, after selecting at least one of the one or more virtual milling tools, the one or more virtual whipstocks, or the one or more virtual wellbore casings in act 2060, the interface engine may be used to access one or more files containing milling tool parameters, whipstock parameters, or wellbore casing parameters (see act 2010) and/or to generate a milling user interface (see act 2020), or utilize a virtualizing engine to generate a visual representation of a selected simulation component (see act 2050).

A simulation engine (e.g., simulation engine 312-3 of FIG. 3) may be used to perform a milling simulation involving the selected one or more simulation parameters and the selected one or more simulation components during the downhole milling procedure (act 2070). This milling simulation can then be rendered in one or more output formats, as described herein (act 2080).

FIG. 21 illustrates yet another flow diagram 2100 of an embodiment of a computer implemented method for causing a computing system, like computing system 300, to simulate a downhole milling procedure.

In this embodiment, the computing system generates a milling user interface that displays interactive elements that, in response to user input directed at the interactive elements, are operable for identifying milling tool parameters of one or more virtual milling tools, whipstock parameters of one or more virtual whipstocks, and wellbore casing parameters of one or more virtual wellbore casings (act 2110). In response to received user input (act 2120), the computing system generates a visual representation of at least one of the one or more virtual milling tools, the one or more virtual whipstocks, the one or more virtual wellbore casings, or the virtual downhole milling procedure (act 2130). Generating the visual representation may be performed for instance, as described herein with regard to at least one or more referenced GUI interfaces.

The computing system also identifies one or more simulation parameters and one or more simulation components corresponding to the virtual downhole milling procedure (act 2140). The identified one or more simulation components may including at least one of the one or more virtual milling tools, the one or more virtual whipstocks, or the one or more virtual wellbore casings as selected or modified by the user input directed at the interactive elements. One or more of these components may also, or instead, be preselected by the GUI or in response to input from field data or remote computing systems.

The computing system may perform a milling simulation based on the one or more simulation parameters and the identified one or more simulation components (act 2150) and render one or more visual outputs associated with the milling simulation (act 2160), as generally described herein.

The foregoing methods can apply to various types of simulated milling procedures, including simulated wellbore departure processes that include milling of virtual windows in one or more virtual wellbore casings (even nested casings with or without cement positioned therebetween, or with or without cement between a casing and a wellbore wall). The simulated milling procedures can also include simulating and storing and/or providing performance data that includes any combination of parameters corresponding to window quality, window shape, walk rate, von Mises stress, vibration, bending moment, milling tool wear rate, whipstock material removal, resulting whipstock shape, contact force, rate of penetration, downhole weight-on-bit, downhole rotational speed, surface torque, mill trajectory, or the like.

Parameters provided and utilized for the simulation(s) include any combination of milling tool parameters, whipstock parameters, wellbore casing parameters, wellbore parameters, and milling simulation and milling performance parameters.

In some embodiments, the milling tool parameters of the virtual whipstock include one or more of number of mills, bottomhole assembly components, axial position, cutting blade number, cutting blade geometry, cutting element positions, or material type. In the same or other embodiments, the whipstock parameters include one or more of ramp number, ramp angle, ramp length, concavity, whipstock material, or azimuth, while the wellbore casing parameters may include one or more of casing material, number of casings, casing geometry, casing position, cement material, cement location, cement quality, or cement geometry, and the one or more simulation parameters include one or more of mill trajectory, rotational speed, weight-on-bit, wellbore parameters, or formation properties.

According to some embodiments, the performance of the milling simulation generates milling performance parameters including one or more of stress, vibration, bending moment, wear rate, whipstock material removal, resulting whipstock shape, contact force, rate of penetration, downhole weight-on-bit, downhole rotational speed, surface torque, resulting mill trajectory, window quality, window shape, walk rate, walk direction, or milling tool deformation.

It will be appreciated that embodiments of the present disclosure allow a BHA user of a simulation or computing system predict performance of a BHA and/or to compare and contrast performance characteristics of one or more BHAs under various wellbore conditions and during various milling operations. In some embodiments of the present disclosure, a BHA designer may review simulated performance of the BHA as a function of location along the BHA (or distance from a bit or other component). By providing outputs that show performance as a function of length or distance, the BHA designer can obtain information indicative of locations with high stress, high vibration, high accelerations, or other deleterious effects. The BHA designer can then add, remove, move, or modify components on the BHA to reduce, modify, or eliminate these deleterious effects. By allowing a designer to review locational information, the overall performance of the BHA may be improved.

In addition, the present disclosure allows a BHA designer to investigate the performance of multiple BHAs having a dynamic input. A dynamic input includes an input that varies during the course of a simulation. For example, the RPM may be varied (e.g., with the bit either drilling or not drilling) to determine a speed to be avoided during drilling. Similarly, the WOB may be varied over the course of the simulation (e.g., from 0 to a selected value, or between two values higher than 0). Similarly, the WOB of the BHA may be entered as a dynamic input, and allowed to change over the course of the simulation. Further still, the size of a bit, stabilizer, mill, or other component may change over time (e.g., as wear increases). By having a dynamic input (which may be fed into the simulation system from a performance parameter in some embodiments), selected embodiments of the present disclosure may allow a BHA designer to suggest operating parameters to be avoided, or to be used by a driller when actually drilling a well with a correspondingly structured BHA.

Further, embodiments of the present disclosure may allow for a milling engineer, or BHA designer, to efficiently select or modify a BHA to be used for milling by providing a method and system by which various BHAs can be simulated and their performance analyzed. The simulation results, models, and data for comparing one or more BHAs (either to one another, to specific criteria, to field tested BHAs, etc.) may help engineers determine an optimized or favored BHA for use in milling operations meeting certain criteria. Additionally, by analyzing various BHA parameters, a designer can select the optimized BHA for specific wellbore conditions and/or milling operations based on one or more milling performance parameters.

Embodiments of the present disclosure may generally be performed by a computing device or system, and more particularly performed in response to instructions provided by one or more applications or modules executing on one or more computing devices within a system. In other embodiments of the present disclosure, hardware, firmware, software, computer program products, other programming instructions, or any combination of the foregoing, may be used in directing the operation of a computing device or system.

Embodiments of the present disclosure may thus utilize a special purpose or general-purpose computing system including computer hardware, such as, for example, one or more processors and system memory. Embodiments within the scope of the present disclosure also include physical and other computer-readable media for carrying or storing computer-executable instructions and/or data structures, including applications, tables, data, libraries, or other modules used to execute particular functions or direct selection or execution of other modules. Such computer-readable media can be any available media that can be accessed by a general purpose or special purpose computer system. Computer-readable media that store computer-executable instructions (or software instructions) are physical storage media. Computer-readable media that carry computer-executable instructions are transmission media. Thus, by way of example, and not limitation, embodiments of the present disclosure can include at least two distinctly different kinds of computer-readable media, namely physical storage media and/or transmission media. Combinations of physical storage media and transmission media should also be included within the scope of computer-readable media.

Both physical storage media and transmission media may be used temporarily store or carry, software instructions in the form of computer readable program code that allows performance of embodiments of the present disclosure. Physical storage media may further be used to persistently or permanently store such software instructions. Examples of physical storage media include physical memory (e.g., RAM, ROM, EPROM, EEPROM, etc.), optical disk storage (e.g., CD, DVD, HDDVD, Blu-ray, etc.), storage devices (e.g., magnetic disk storage, tape storage, diskette, etc.), flash or other solid-state storage or memory, or any other non-transmission medium which can be used to store program code in the form of computer-executable instructions or data structures and which can be accessed by a general purpose or special purpose computer, whether such program code is stored as or in software, hardware, firmware, or combinations thereof.

A "communication network" may generally be defined as one or more data links that enable the transport of electronic data between computer systems and/or modules, engines, and/or other electronic devices. When information is transferred or provided over a communication network or another communications connection (either hardwired, wireless, or a combination of hardwired or wireless) to a computing device, the computing device properly views the connection as a transmission medium. Transmission media can include a communication network and/or data links, carrier waves, wireless signals, and the like, which can be used to carry desired program or template code means or instructions in the form of computer-executable instructions or data structures and which can be accessed by a general purpose or special purpose computer.

Further, upon reaching various computer system components, program code in the form of computer-executable instructions or data structures can be transferred automatically or manually from transmission media to physical storage media (or vice versa). For example, computer-executable instructions or data structures received over a network or data link can be buffered in memory (e.g., RAM) within a network interface module (NIC), and then eventually transferred to computer system RAM and/or to less volatile physical storage media at a computer system. Thus, it should be understood that physical storage media can be included in computer system components that also (or even primarily) utilize transmission media.

Computer-executable instructions include, for example, instructions and data which, when executed at one or more processors, cause a general purpose computer, special purpose computer, or special purpose processing device to perform a certain function or group of functions. The computer-executable instructions may be, for example, binaries, intermediate format instructions such as assembly language, or even source code. Although the subject matter of certain embodiments herein may have been described in language specific to structural features and/or methodological acts, it is to be understood that the subject matter of the present disclosure, is not limited to the described features or acts described herein, nor performance of the described acts by the components described herein. Rather, the described features and acts are disclosed as example forms of implementing the some aspects of the present disclosure.

In the description herein, various relational terms are provided to facilitate an understanding of various aspects of some embodiments of the present disclosure. Relational terms such as "bottom," "below," "top," "above," "back," "front," "left," "right," "rear," "forward," "up," "down," "horizontal," "vertical," "clockwise," "counterclockwise," "upper," "lower," "uphole," "downhole," and the like, may be used to describe various components, including their operation and/or illustrated position relative to one or more other components. Relational terms do not indicate a particular orientation for each embodiment within the scope of the description or claims. For example, a component of a bottomhole assembly that is described as "below" another component may be further from the surface while within a vertical wellbore, but may have a different orientation during assembly, when removed from the wellbore, or in a deviated or other lateral borehole. Accordingly, relational descriptions are intended solely for convenience in facilitating reference to various components, but such relational aspects may be reversed, flipped, rotated, moved in space, placed in a diagonal orientation or position, placed horizontally or vertically, or similarly modified. Certain descriptions or designations of components as "first," "second," "third," and the like may also be used to differentiate between identical components or between components which are similar in use, structure, or operation. Such language is not intended to limit a component to a singular designation. As such, a component referenced in the specification as the "first" component may be the same or different than a component that is referenced in the claims as a "first" component.

Furthermore, while the description or claims may refer to "an additional" or "other" element, feature, aspect, component, or the like, it does not preclude there being a single element, or more than one, of the additional or other element. Where the claims or description refer to "a" or "an" element, such reference is not be construed that there is just one of that element, but is instead to be inclusive of other components and understood as "at least one" of the element. It is to be understood that where the specification states that a component, feature, structure, function, or characteristic "may," "might," "can," or "could" be included, that particular component, feature, structure, or characteristic is provided in some embodiments, but is optional for other embodiments of the present disclosure. The terms "couple," "coupled," "connect," "connection," "connected," "in connection with," and "connecting" refer to "in direct connection with," or "in connection with via one or more intermediate elements or members." Components that are "integral" or "integrally" formed include components made from the same piece of material, or sets of materials, such as by being commonly molded or cast from the same material, or machined from the same one or more pieces of material stock. Components that are "integral" should also be understood to be "coupled" together.

Any element described in relation to an embodiment herein may be combinable with any element (or any number of other elements) of any other embodiment(s) described herein. Although a few specific example embodiments have been described in detail herein, those skilled in the art will readily appreciate in view of the disclosure herein that many modifications to the example embodiments are possible without materially departing from the disclosure provided herein. Accordingly, such modifications are intended to be included in the scope of this disclosure. Likewise, while the disclosure herein contains many specifics, these specifics should not be construed as limiting the scope of the disclosure or of any of the appended claims, but merely as providing information pertinent to one or more specific embodiments that may fall within the scope of the disclosure and the appended claims. In addition, other embodiments of the present disclosure may also be devised which lie within the scopes of the disclosure and the appended claims. All additions, deletions, and modifications to the embodiments that fall within the meaning and scopes of the claims are to be embraced by the claims.

Certain embodiments and features may have been described using numerical examples, including sets of numerical upper limits and sets of numerical lower limits. It should be appreciated that ranges including the combination of any two values, are contemplated, or that any single value may be selected as a lower or upper value. Numbers, percentages, ratios, or other values stated herein are intended to include that value, and also other values that are "about" or "approximately" the stated value, as would be appreciated by one of ordinary skill in the art encompassed by embodiments of the present disclosure. A stated value should therefore be interpreted broadly enough to encompass values that are at least close enough to the stated value to perform a desired function or achieve a desired result. The stated values include at least the variation to be expected in a suitable manufacturing or production process, and may include values that are within 10%, within 5%, within 1%, within 0.1%, or within 0.01% of a stated value.

A person having ordinary skill in the art should realize in view of the present disclosure that equivalent constructions do not depart from the spirit and scope of the present disclosure. Equivalent constructions, including functional "means-plus-function" clauses are intended to cover the structures described herein as performing the recited function, including both structural equivalents that operate in the same manner, and equivalent structures that provide the same function. It is the express intention of the applicant not to invoke means-plus-function or other functional claiming for any claim except for those in which the words 'means for' appear together with an associated function. Each addition, deletion, and modification to the embodiments that falls within the meaning and scope of the claims is to be embraced by the claims.

While embodiments disclosed herein may be used in oil, gas, or other hydrocarbon exploration or production environments, such environments are merely illustrative. Systems, tools, methods, milling systems, and other components of the present disclosure, or which would be appreciated in view of the disclosure herein, may be used in other applications and environments. In other embodiments, computing systems, milling tools, methods of milling, methods of simulating a milling procedure, or other embodiments discussed herein, or which would be appreciated in view of the disclosure herein, may be used outside of a downhole environment, including in connection with other systems, including within automotive, aquatic, aerospace, hydroelectric, manufacturing, other industries, or even in other downhole environments. The terms "well," "wellbore," "borehole," and the like are therefore also not intended to limit embodiments of the present disclosure to a particular industry. A wellbore or borehole may, for instance, be used for oil and gas production and exploration, water production and exploration, mining, utility line placement, or myriad other applications.

What is claimed is:

1. A computing system comprising:

one or more hardware processors; and one or more storage devices having stored computer-executable instructions which, when executed by the one or more hardware processors, are configured to cause the computing system to:

access parameters of a virtual whipstock and parameters of a virtual milling tool;

simulate a milling procedure, wherein simulating the milling procedure includes:

selecting one or more milling simulation parameters based at least partially on the parameters of the virtual whipstock and the parameters of the virtual milling tool; and applying the one or more milling simulation parameters to control a simulation of the milling procedure by simulating an interaction of the virtual milling tool with the virtual whipstock; and render one or more visual outputs associated with the simulated milling procedure, the one or more visual outputs including a plurality of locations or nodes of at least one of the virtual whipstock or the virtual milling tool.

2. The computing system of claim 1, the stored computer-executable instructions being configured to cause the computing system to simulate the milling procedure by performing a finite element analysis of at least one of the virtual whipstock or the virtual milling tool.

3. The computing system of claim 2, the stored computer-executable instructions being configured to cause the computing system to iteratively perform the finite element analysis for different moments in time during the simulated milling procedure by dynamically varying at least one of the parameters of the virtual whipstock and the parameters of the virtual milling tool during the simulated milling procedure.

4. The computing system of claim 1, the stored computer-executable instructions being configured to cause the computing system to render the one or more visual outputs by rendering an animation of the simulated milling procedure.

5. The computing system of claim 1, the stored computer-executable instructions being configured to further cause the computing system to modify one or more of the parameters of the virtual whipstock or the parameters of the virtual milling tool in response to user input, and to perform a new simulation with one or more of the virtual whipstock or the virtual milling tool with the modified parameters.

6. The computing system of claim 1, the stored computer-executable instructions being configured to further cause the computing system to:

access parameters of a virtual wellbore casing; and simulate an interaction of the virtual milling tool with the virtual wellbore casing during the simulated milling procedure.

7. The computing system of claim 1, wherein:

the virtual milling tool comprises a plurality of virtual milling tools;

simulating the milling procedure comprises simulating a plurality of milling procedures by at least simulating an interaction of the plurality of virtual milling tools with the virtual whipstock;

the one or more visual outputs are associated with the simulated plurality of milling procedures; and the computing system is further configured to:

determine a probability of success or failure of each of the virtual milling tools in response to simulating the plurality of milling procedures, rendering the one or more visual outputs, or both; and select a real milling tool corresponding to one of the virtual milling tools with the best probability of success for use with a real whipstock corresponding to the virtual whipstock.

8. The computing system of claim 1, wherein the computing system is further configured to compare the one or more visual outputs associated with the simulated milling procedure to actual field results to calibrate the computing system to improve accuracy of subsequent simulation procedures.

9. The computing system of claim 1, wherein the computing system is further configured to modify at least one of one or more of the parameters of the virtual whipstock or one or more of the parameters of the virtual milling tool, based on an output of the simulated milling procedure.

10. The computing system of claim 9, whereby a bottom-hole assembly is designed using the virtual whipstock, the virtual milling tool, or both after modifying the at least one of the one or more of the parameters of the virtual whipstock or the one or more of the parameters of the virtual milling tool.

11. A computer program product comprising:

one or more computer hardware storage devices having stored computer-executable instructions which, when executed by one or more processors, cause a computing system having one or more processors, an interface engine, a visualization engine, and a simulation engine, to simulate a downhole milling procedure by:

utilizing the interface engine to access one or more files containing milling tool parameters specifying characteristics of one or more virtual milling tools, whipstock parameters specifying characteristics of one or more virtual whipstocks, and wellbore casing parameters specifying characteristics of one or more virtual wellbore casings;

utilizing the interface engine to generate a milling user interface that displays interactive elements that, in response to user input directed at the interactive elements, are operable for at least one of selecting or modifying one or more of the milling tool parameters, one or more of the whipstock parameters, or one or more of the wellbore casing parameters;

in response to receiving the user input directed at the interactive elements, responsively selecting and modifying at least one of the milling tool parameters, the whipstock parameters, or the wellbore casing parameters;

utilizing the virtualizing engine to generate a visual representation of at least one of the one or more virtual milling tools, the one or more virtual whipstocks, or the one or more virtual wellbore casings selected or modified by the user input;

utilizing the interface engine to select one or more simulation parameters and one or more simulation components corresponding to the downhole milling procedure, the selected one or more simulation components including at least one of the one or more virtual milling tools, the one or more virtual whipstocks, or the one or more virtual wellbore casings selected or modified by the user input;

utilizing the simulation engine to perform a milling simulation involving the selected one or more simulation parameters and the selected one or more simulation components during the downhole milling procedure; and rendering one or more visual outputs associated with the milling simulation of the downhole milling procedure, the one or more visual outputs including a plurality of locations or nodes of at least one of the virtual whipstock or the virtual milling tool.

12. The computer program product of claim 11, utilizing the simulation engine to perform the milling simulation including performing a finite element analysis on the selected one or more simulation components.

13. The computer program product of claim 11, rendering the one or more visual outputs associated with the milling simulation including rendering an animation with at least one of the one or more virtual milling tools, the one or more virtual whipstocks, or the one or more virtual wellbore casings to visually represent at least a portion of the downhole milling procedure.

14. The computer program product of claim 11, the selected one or more simulation components including a virtual whipstock, at least one virtual milling tool, and a virtual wellbore casing.

15. The computer program product of claim 14, utilizing the simulation engine to perform the milling simulation including performing a simulation of a wellbore departure procedure that includes milling of a window in the virtual wellbore casing.

16. The computer program product of claim 11, utilizing the simulation engine to perform the milling simulation including simulating at least one of window quality, window shape, walk rate, von Mises stress, vibration, bending moment, milling tool wear rate, whipstock material removal, resulting whipstock shape, contact force, rate of penetration, downhole weight-on-bit, downhole rotational speed, surface torque, or mill trajectory.

17. The computer program product of claim 11, the selected one or more simulation components including a plurality of virtual wellbore casings, the plurality of virtual wellbore casings including at least a first virtual wellbore casing within a second virtual wellbore casing.

18. The computer program product of claim 17, the selected one or more simulation components including virtual cement barrier positioned between the first virtual wellbore casing and the second virtual wellbore casing, and wherein the one or more files accessed by the interface engine include cement parameters associated with the virtual cement barrier.

19. The computer program product of claim 11, the one or more simulation parameters including at least one of contact force, weight-on-bit, rotational speed, surrounding formation, or mill trajectory.

20. A computer-implemented method performed by a computing system that includes one or more storage devices having stored computer-executable instructions which, when executed by one or more processors of the computing system, cause the computing system to perform a downhole milling procedure simulation comprising:

generating a milling user interface that displays interactive elements that, in response to user input directed at the interactive elements, are operable for identifying milling tool parameters of one or more virtual milling tools, whipstock parameters of one or more virtual whipstocks, and wellbore casing parameters of one or more virtual wellbore casings;

in response to receiving the user input directed at the interactive elements, generating a visual representation of at least one of the one or more virtual milling tools, the one or more virtual whipstocks, the one or more virtual wellbore casings, or the virtual downhole milling procedure;

identifying one or more simulation parameters and one or more simulation components corresponding to the virtual downhole milling procedure, the identified one or more simulation components including at least one of the one or more virtual milling tools, the one or more virtual whipstocks, or the one or more virtual wellbore casings as selected or modified by the user input directed at the interactive elements;

performing a milling simulation based on the one or more simulation parameters and the identified one or more simulation components by generating milling performance parameters including one or more of whipstock material removal or resulting whipstock shape; and rendering one or more visual outputs associated with the milling simulation, the one or more visual outputs including a plurality of locations or nodes of at least one of the virtual whipstock or the virtual milling tool.

21. The method of claim 20, the simulated milling procedure including a wellbore departure procedure.

22. The method of claim 20, the identified one or more simulation components including each of a virtual whipstock, at least one virtual milling tool, and a virtual wellbore casing.

23. The method of claim 22, wherein:

the milling tool parameters of the virtual whipstock include one or more of number of mills, bottomhole assembly components, axial position, cutting blade number, cutting blade geometry, cutting element positions, or material type;

the whipstock parameters include one or more of ramp number, ramp angle, ramp length, concavity, whipstock material, or azimuth;

the wellbore casing parameters include one or more of casing material, number of casings, casing geometry, casing position, cement material, cement location, cement quality, or cement geometry;

the one or more simulation parameters include one or more of mill trajectory, rotational speed, weight-on-bit, or formation properties; and the milling performance parameters further include one or more of stress, vibration, bending moment, wear rate, contact force, rate of penetration, downhole weight-on-bit, downhole rotational speed, surface torque, resulting mill trajectory, window quality, window shape, walk rate, walk direction, or milling tool deformation.

24. The method of claim 20, the interactive elements displayed by the milling user interface including interactive elements operable to receive user input defining the one or more simulation parameters, the one or more simulation parameters including parameters that define at least one of rotational speed, weight-on-bit, or trajectory for the one or more virtual milling tools.

* * * * *